US010540856B2

(12) United States Patent
Grace

(10) Patent No.: US 10,540,856 B2
(45) Date of Patent: Jan. 21, 2020

(54) ELECTRONIC GAMING DEVICE WITH SLASH FUNCTIONALITY

(71) Applicant: Cadillac Jack Inc., Duluth, GA (US)

(72) Inventor: Jason Dean Grace, Lilburn, GA (US)

(73) Assignee: AGS LLC, Las Vegas, NV (US)

( * ) Notice: Subject to any disclaimer, the term of this patent is extended or adjusted under 35 U.S.C. 154(b) by 280 days.

(21) Appl. No.: 14/096,251

(22) Filed: Dec. 4, 2013

(65) Prior Publication Data

US 2015/0154834 A1 Jun. 4, 2015

(51) Int. Cl.
*G07F 17/34* (2006.01)
*G07F 17/32* (2006.01)

(52) U.S. Cl.
CPC ..... *G07F 17/34* (2013.01); *G07F 17/3244* (2013.01)

(58) Field of Classification Search
CPC .... G07F 17/34; G07F 17/326; G07F 17/3213; G07F 17/32; G07F 17/3244; G07F 17/3262; G07F 17/3267
See application file for complete search history.

(56) References Cited

U.S. PATENT DOCUMENTS

2001/0016513 A1* 8/2001 Muir ..... G07F 17/34 463/16
2003/0013519 A1* 1/2003 Bennett ..... G07F 17/32 463/25
2004/0224751 A1* 11/2004 Jaffe et al. ..... 463/20
2006/0046830 A1* 3/2006 Webb ..... G07F 17/3213 463/20
2006/0160621 A1* 7/2006 Rowe et al. ..... 463/42
2009/0137309 A1* 5/2009 Thomas ..... G07F 17/3211 463/20
2009/0181770 A1* 7/2009 Viner ..... A63F 13/10 463/37
2009/0186680 A1* 7/2009 Napolitano et al. ..... 463/17
2010/0160045 A1* 6/2010 Yamada ..... A63F 13/02 463/37
2010/0190543 A1* 7/2010 Englman ..... G07F 17/34 463/20
2011/0117990 A1* 5/2011 Wilkins ..... G07F 17/3258 463/20
2013/0012319 A1* 1/2013 Negroponte ..... A63F 13/92 463/37
2014/0087832 A1* 3/2014 Zoltewicz ..... G07F 17/326 463/20
2014/0172373 A1* 6/2014 Edwards ..... 702/189

* cited by examiner

*Primary Examiner* — Tramar Y Harper
*Assistant Examiner* — Jeffrey K Wong
(74) *Attorney, Agent, or Firm* — Weide & Miller, Ltd.

(57) ABSTRACT

Examples disclosed herein relate to an electronic gaming device including a memory, a processor, and a plurality of reels. The memory may include one or more slash feature structures. The processor may generate one or more symbols to be located in the one or more areas. The processor may generate one or more slashing symbols. The processor may obtain one or more inputs relating to the one or more slashing symbols.

11 Claims, 41 Drawing Sheets

ELECTRONIC GAMING DEVICE WITH SLASH FUNCTIONALITY

FIELD

The subject matter disclosed herein relates to an electronic gaming device. More specifically, the disclosure relates to providing one or more slash functionalities on a gaming device.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successfully matches the predetermined winning symbols in one of the predetermined patterns.

A player's entertainment while playing one or more games may be enhanced by utilizing one or more slash functionalities on the gaming device. By increasing the player's entertainment level, the player's enjoyment of the game may be enhanced, which may increase a player's game playing period.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
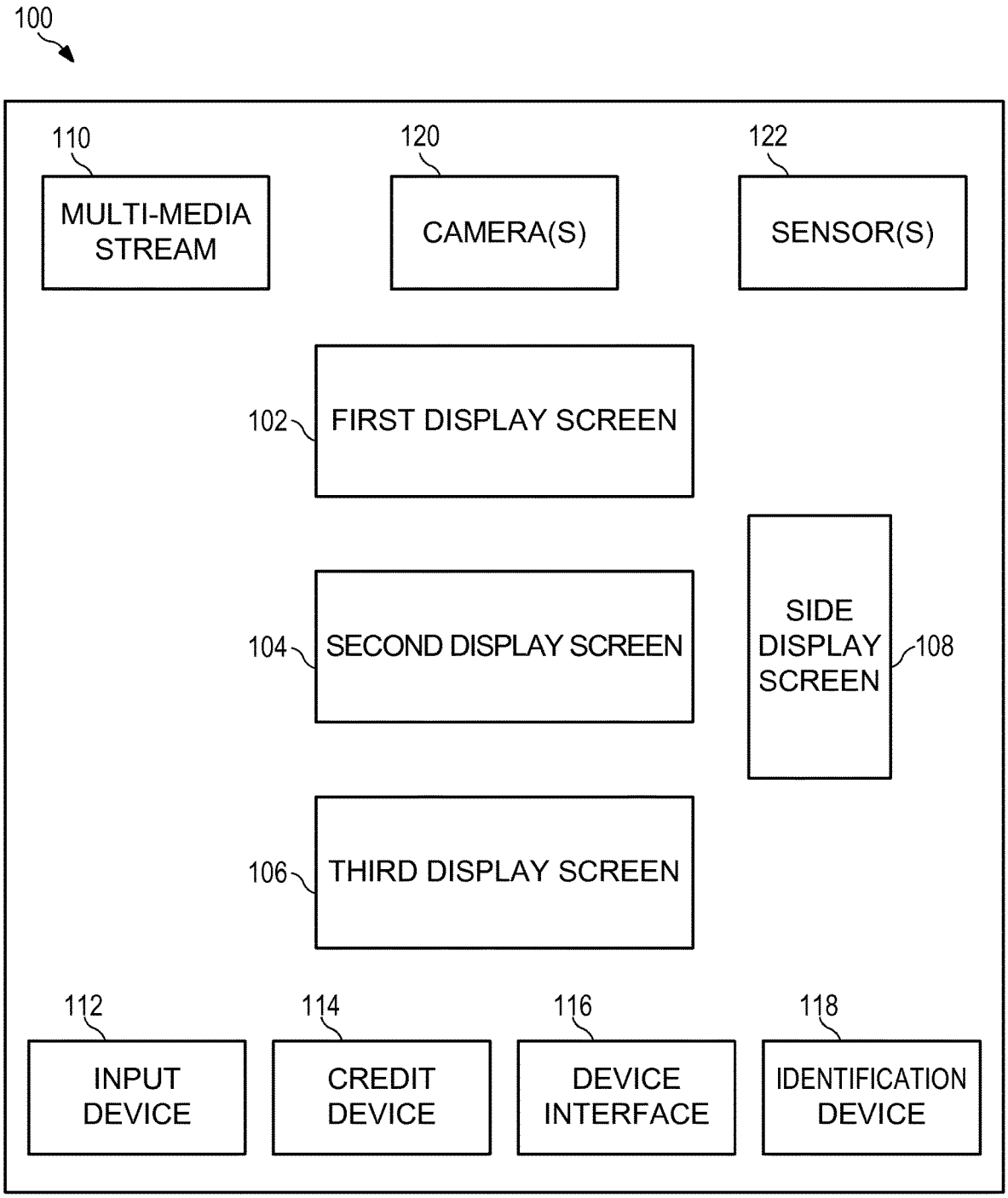
FIG. 1 is an illustration of the electronic gaming device, according to one embodiment.

FIG. 1 is an illustration of an electronic gaming device 100. Electronic gaming device 100 may include a multimedia stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to select one or more slash gaming options, to make a wager, to control any object, to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more game functionalities (e.g., game type 1, game type 2, game type 3, etc.) may be presented, a slash gaming option may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, the player may only want to play games that include slash gaming options only. Therefore, only games which include slash gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, to display one or more warnings relating to one or more audio devices, one or more display devices, one or more electrical wires, one or more springs, one or more motors, one or more adjustable devices, and/or one or more sensors, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multimedia data, which may be displayed on any display combination.

One or more cameras 120 and/or one or more sensors 122 may be utilized as one or more depth image sensing devices, which may be located in various locations, including but not limited to, above the base display, above second display, in one or more locations on gaming cabinet front, on a side of the gaming cabinet other than gaming cabinet front, and/or any other location.

In one embodiment, electronic gaming device 100 may not include separate one or more input devices, but instead may only utilize one or more depth image sensing devices. In another embodiment, a player may utilize one or more input devices and/or may utilize gestures that electronic gaming device 100, via one or more depth image sensing devices, recognizes in order to make inputs for a play of a game. A player may interact with electronic gaming device 100 via one or more depth image sensing devices for a plurality of various player inputs.

In one embodiment, one or more depth image sensing devices may include at least two similar devices. For example, each of the at least two similar devices may independently sense depth and/or image of a scene. In another example, such similar depth image sensing devices may then communicate information to one or more processors, which may utilize the information from each of the similar depth image sensing devices to determine the relative depth of an image from a captured scene.

In another embodiment, one or more depth image sensing devices may include at least two different devices. For example, and discussed in more detail below, one of the at least two different devices may be an active device and/or one of the at least two different devices may be a passive device. In one example, such an active device may generate a wave of measurable energy (e.g., light, radio, etc.). In another example, such a passive device may be able to detect reflected waves generated by such an active device. In another example, such an active device and such a passive device may each communicate data related to their respective activity to a processor, and such processor may translate such data in order to determine the depth and/or image of a scene occurring near electronic gaming device 100.

Electronic gaming device 100 may include at least one display device. Electronic gaming device 100 may include a base display and/or a second display. In one embodiment, base display may be the primary display for a first game. In another embodiment, second display may be the primary display for a second and/or bonus game. For example, base display may display: a reel-type video slot game; and upon a bonus game triggering condition; second display may display a bonus game; and upon a slash game feature triggering event; first and/or second display may display a slash game feature.

In one embodiment, base display and second display may display separate portions of a common image. For example, second display may display a top portion of a wheel spinning while base display may display the bottom portion of the same wheel spinning.

Electronic gaming device 100 may also include one or more speakers. In one embodiment, one or more speakers may work in a synchronized manner to provide a surround sound effect. For example, as an object is displayed moving across base display from left to right, one or more speakers may produce sound in such a manner as to create an audible sense of similar left to right movement. In another embodiment, one or more speakers may work asynchronously. In a further embodiment, a first speaker may produce sounds associated with a first symbol appearing in a play of a game, and a second speaker may produce sounds associated with a second symbol appearing in a play of the game.

Figure 2:
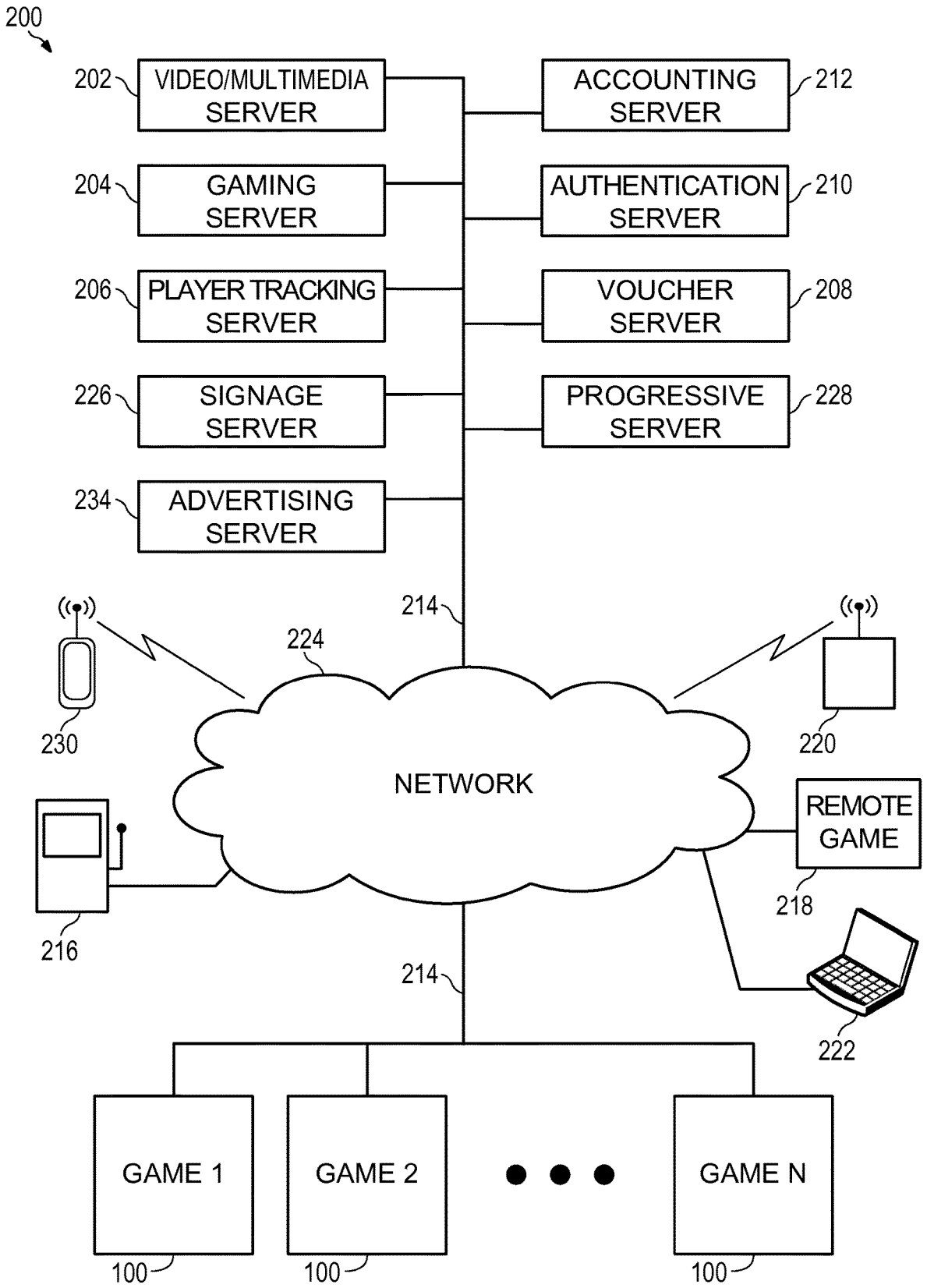
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of: a slash game feature functionality; a slash game feature evaluation functionality; a payout functionality; a base and/or bonus game play functionality; a base and/or bonus game play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Figure 3:
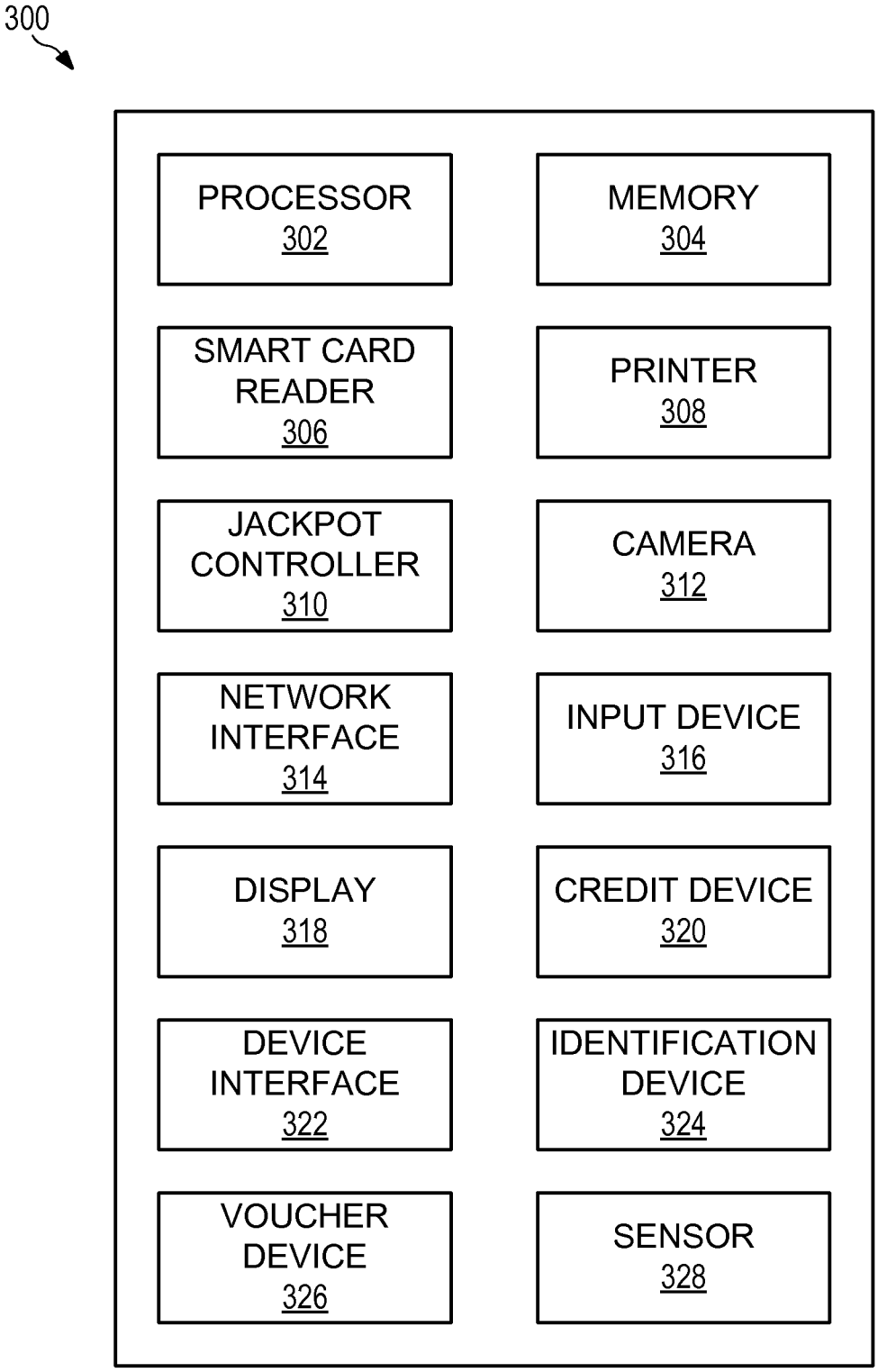
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine his or her picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to select one or more gaming options, to make an offer to buy or sell a voucher, to determine a voucher's worth, to cash in a voucher, to modify electronic gaming device 100 (e.g., change sound level, configuration, font, language, etc.), to modify one of one or more audio devices, one or more display devices, one or more electrical wires, one or more springs, one or more motors, one or more adjustable devices, and/or one or more sensors, to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
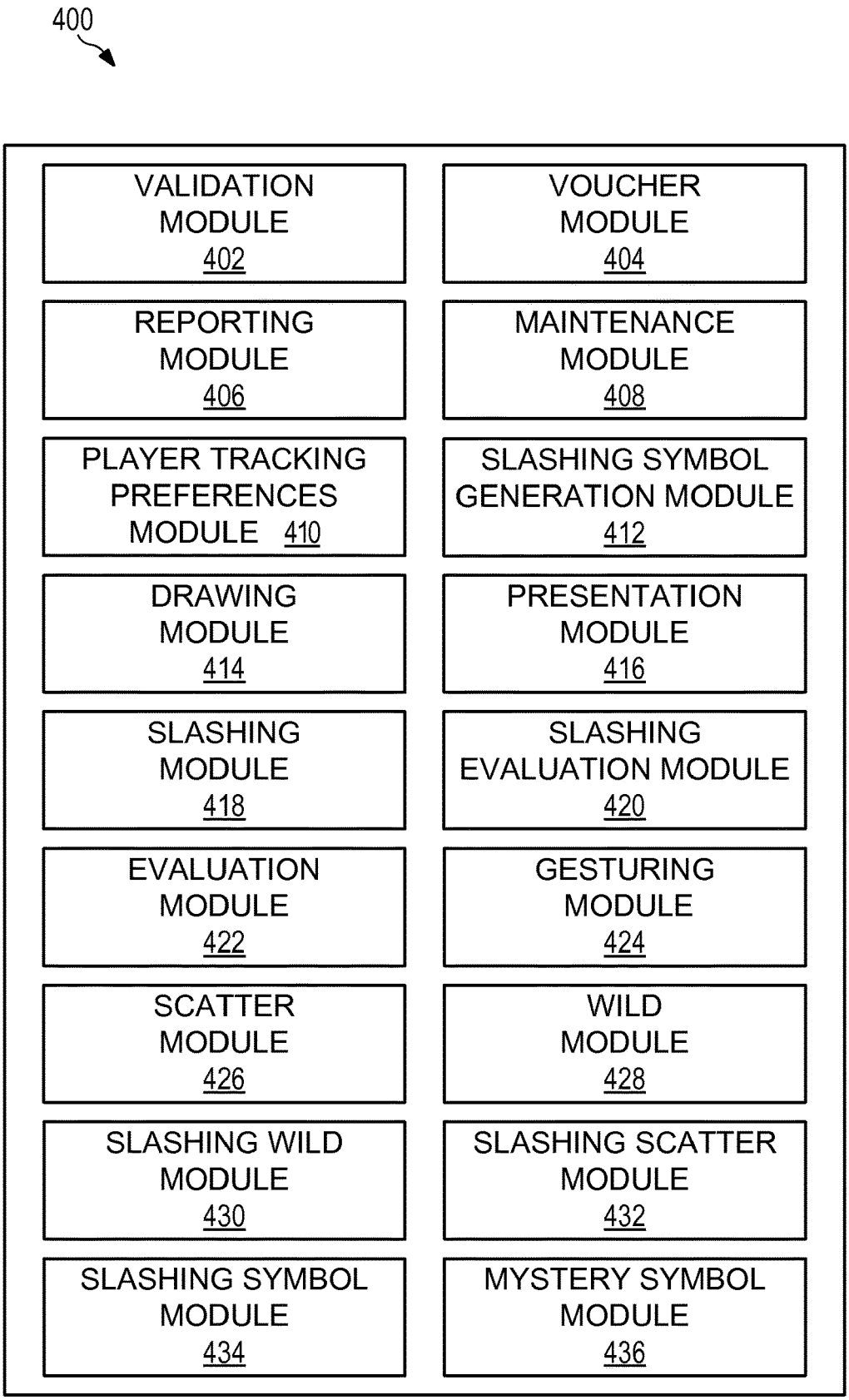
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, a slashing symbol generation module 412, a drawing module 414, a presentation and implementation module 416, slashing module 418, an animation module, a slashing evaluation module 420, an evaluation module 422, a gesturing module 424, a scatter module 426, a wild module 428, a slashing wild module 430, a slashing scatter module 432, a slashing symbol module 434, a mystery symbol module 436, a payout module, a sensor module, a scene module, a sensor and scene evaluation module, a sensor and scene output module, a reference models module, an audio module, an audio device adjustment module, a display device adjustment module, a bonus module, a statistics module, a progressive module, a signage module, and/or an advertisement module.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Animation module may generate, compile, transmit, and/or store one or more animations and/or presentations based on one or more scene data, one or more scenes, one or more reference models, one or more game play data, one or more player profiles, and/or any combination thereof.

Slashing symbol generation module 412 may generate, compile, transmit, display, and/or store one or more slashing symbols which may be utilized on one or more reels and/or one or more screens.

Drawing module 414 may generate, draw, compile, transmit, display, and/or store one or more slashing symbols which may be utilized on one or more reels and/or one or more screens.

Presentation and implementation module 416 may generate, transmit, compile, implement, and/or store one or more presentations.

Slashing module 418 may generate, compile, transmit, display, and/or store one or more slashing actions which may be utilized on one or more reels and/or one or more screens.

Animation module may generate, compile, transmit, display, and/or store one or more animation images and/or data which may be utilized on one or more reels and/or one or more screens.

Slashing evaluation module 420 may evaluate one or more outcomes from one or more slashing games, slashing functions, slashing actions, slashing selections, and/or slashing options.

Evaluation module 422 may evaluate one or more outcomes for one or more events relating to game play.

Gesturing module 424 may generate, compile, transmit, display, store, evaluate, and/or implement one or more actions based on obtained gesturing data.

Scatter module 426 may generate a scatter game, evaluate the results of the scatter game, trigger scatter game presentations, generate scatter game payouts, and/or display any data relating to the scatter game.

Wild module 428 may generate a wild game, evaluate the results of the wild game, trigger wild game presentations, generate wild game payouts, and/or display any data relating to the wild game. Further, wild module 428 may determine one or more outcomes of one or more interactions (e.g., collisions of one or more symbols).

Slashing wild module 430 may generate, compile, transmit, display, and/or store one or more slashing wild actions which may be utilized on one or more reels and/or one or more screens.

Slashing scatter module 432 may generate, compile, transmit, display, and/or store one or more slashing scatter actions which may be utilized on one or more reels and/or one or more screens.

Slashing symbol module 434 may generate, compile, transmit, display, and/or store one or more slashing symbol actions which may be utilized on one or more reels and/or one or more screens.

Mystery symbol module 436 may generate, compile, transmit, display, and/or store one or more mystery symbol actions which may be utilized on one or more reels and/or one or more screens.

Payout module may determine one or more payouts which may relate to one or more inputs received from the player, electronic gaming device 100, and/or electronic gaming system 200.

Sensor module may generate, compile, transmit, and/or store any data relating to one or more scene data, one or more scene, and/or any other sensor data. This data may include one or more gestures (e.g., body movement made by one or more players).

Scene module may generate, compile, transmit, and/or store on one or more scene data, one or more scenes, one or more reference models, one or more game play data, one or more player profiles, and/or any combination thereof.

Sensor and scene evaluation module may evaluate any data stored on, transmitted to, and/or transmitted from sensor module and scene module. Sensor and scene evaluation module may obtain data including one or more gestures (e.g., body movement made by one or more players) from sensor module and compare this data to one or more body reference models, body part reference models, device reference models, gaming device reference models, floor plan reference models, and/or any other reference models from reference models module to determine one or more actions.

Sensor and scene output module may evaluate the combined output of sensor module and scene module.

Reference models module may generate, compile, transmit, and/or store one or more body reference models, body part reference models, device reference models, gaming device reference models, floor plan reference models, and/or any other reference models which can be utilized by any of the other modules.

Audio module may generate, compile, transmit, and/or store one or more audio structures, sound wave configurations, and/or any other audio data.

Audio device adjustment module may adjust one or more audio devices. These devices may be adjusted physically (e.g., moved) and/or by changing one or more device characteristics.

Display device adjustment module may adjust one or more display devices. These devices may be adjusted physically (e.g., moved) and/or by changing one or more device characteristics.

Bonus module may generate a bonus game, evaluate the results of the bonus game, trigger bonus game presentations, generate bonus game payouts, and/or display any data relating to the bonus game.

Statistics module may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Progressive module may generate, transmit, compile, and/or store one or more data points relating to one or more progressives and/or subscription progressives (e.g., a progressive a player selects and pays to enter).

Signage module may generate, transmit, compile, initiate, and/or store one or more presentations for one or more signs.

Advertisement module may generate, transmit, compile, present, implement, initiate, and/or store one or more advertisements.

Installation verification module may verify the installation parameters on one or more of audio devices, one or more display devices, one or more electrical wires, one or more springs, one or more motors, one or more adjustable devices, and/or one or more sensors to one or more reference data points. Installation verification module may generate a warning when the data points are outside of a specific parameter range. One or more warnings may be transmitted to an external device, a server, a mobile device, and/or a warning display on electronic gaming device 100 based on the verification data.

Locking module may control the locking mechanism for one or more audio devices, one or more display devices, one or more electrical wires, one or more springs, one or more motors, one or more adjustable devices, and/or one or more sensors. Locking module may control any locking mechanism for electronic gaming device 100. Locking module may generate a warning when a locking data point is outside of a specific parameter. These warnings may be transmitted to an external device, a server, a mobile device, and/or a warning display on electronic gaming device 100.

It should be noted that one or more modules may be combined into one module. Further, there may be one evaluation module where the determined payout does not depend on whether there were any wild symbols, scatter symbols, treasure based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

In one example, using one or more swiping gestures, a player, and/or players may slash at one or more symbols on one or more reels. In another example, using one or more swiping gestures, a player and/or players may slash at one or more objects on one or more reels. In various examples, this may occur in the bonus game, base game, and/or tournament game mode to reveal new symbols that may complete one or more pay lines, generate multipliers, generate wilds, generate expanding wilds, generate scatters, generate free spins, generate another prize (e.g., free dinner, free concert, etc.), generate another slashing level (e.g., level 1 after one slashing action which may equal prize 1, level 2 after two slashing actions which may equal prize 2, level 3 after three slashing actions which may equal prize 3, etc.—in another example, level 1 after two slashing actions which may equal prize 2, level 2 after five slashing actions which may equal prize 4, level 3 after 10 slashing actions which may equal prize 7, etc.), and/or generate credits.

In another example, any number of symbols on any number of reels may randomly start pulsating; with the word "Slash" hovering over them (and/or any other word and/or any other image, and/or any other symbol). The players may then make a slashing gesture over each of the pulsating symbols to reveal one or more new symbols underneath. Further, these symbols may complete one or more pay lines that may not have otherwise occurred.

In another example, a pay line is awarded, immediately the symbols in the pay line start pulsating (and/or any other identification process). The player may slash the symbols to reveal multipliers, additional credits, free spins, and/or any other item of value, which may be added to the original pay line win.

In another example, there may be a mystery symbol that may have any number of surprises hidden within it. When this symbol lands on a reel, the player slashes it to reveal multipliers, wilds, additional credits, free spins, and/or any item of value.

In various examples, the game may be theme based. The theme may be a lumber jack slashing logs, a Samurai slashing with his sword, using the swipe gesture not only to slash but to throw/flick darts, ninja stars, playing cards, discs, Frisbees, to hit a target that reveals credits, multipliers, etc., a karate master slashing stacks of wood, bricks, bamboo, etc., medieval knight slashing goblins, dragons, ogres, etc., chef slashing veggies, eggs, whatever as they tumble down towards a big pot of stew, slashed ingredients may be combined to produce a special win, sword fighting bonus where slashing through hoards of bad guys, fighting evil opponents, slashing skeletons, slashing zombies, slashing open treasure chests, canisters, revealing gold inside, etc.

Figure 5A:
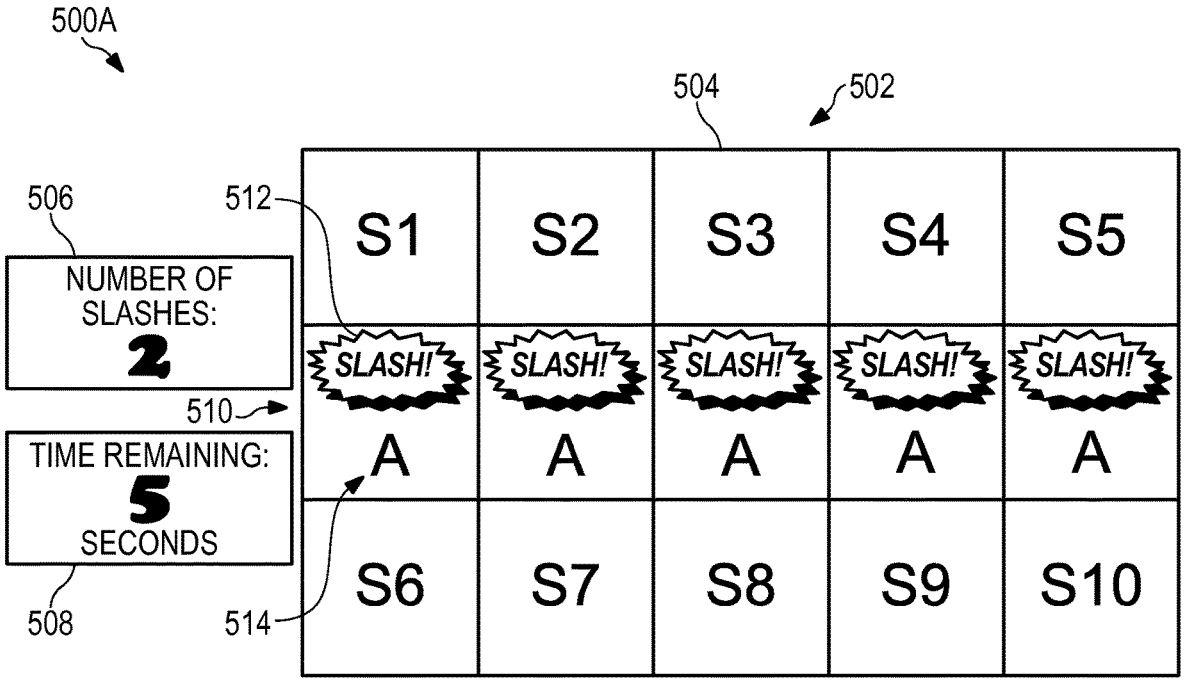
FIG. 5A is an illustration of slash game play on a gaming device, according to one embodiment.

In FIG. 5A, an illustration of slash game play on a gaming device is shown, according to one embodiment. A first image 500A may include a display area 502, one or more reels 504, a slash counter 506, a slash timer 508, a winning payline 510, one or more slashing identification areas 512, and one or more winning symbols 514. In one example, slash counter 506 may count down the number of slashes left for the player to utilize. In another example, slash timer 508 may count down the time period remaining for the player to perform one or more slashes. In another example, winning payline 510 may include five aces where five slashing identification areas 512 are displayed over each of the five aces (e.g., winning pay line symbols). In this example, slash counter 506 indicates that the player has 2 slashes remaining. In another example, slash timer 508 indicates that 5 seconds are remaining for the player to implement one or more slashes. In another example, the slash counter 506 and the slash timer 508 may be utilized together.

Figure 5B:
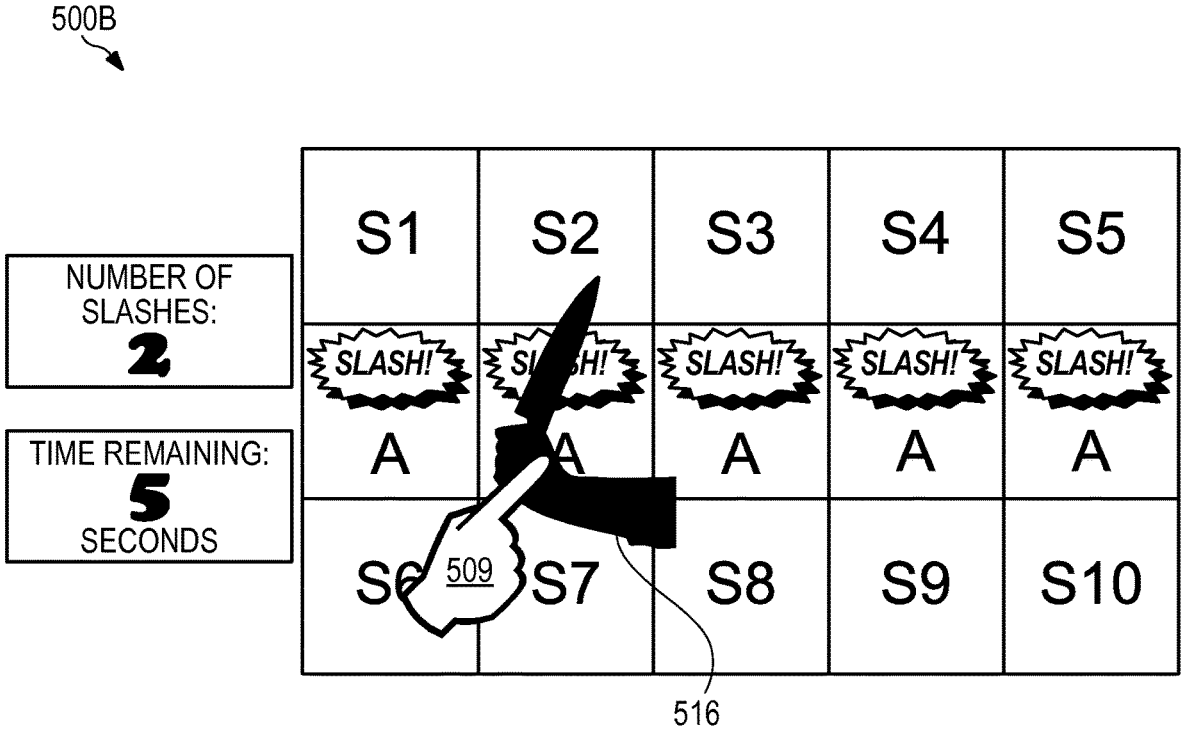
FIG. 5B is another illustration of slash game play on a gaming device, according to one embodiment.
Figure 5C:
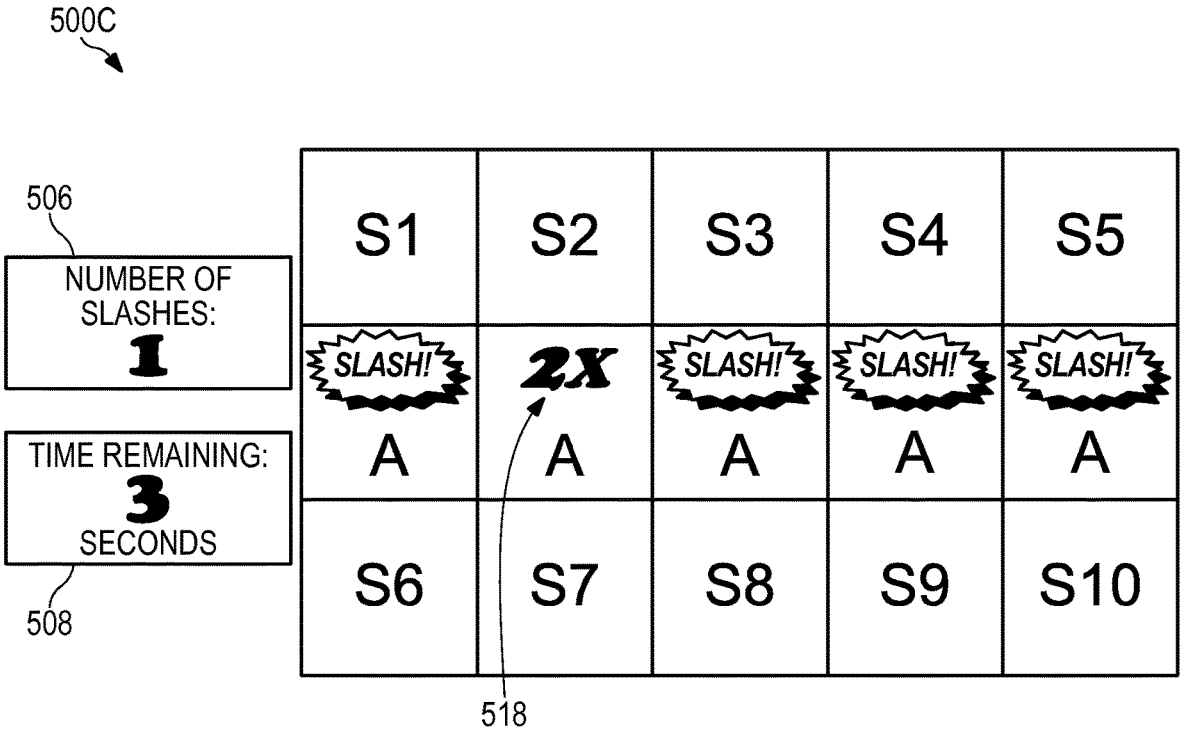
FIG. 5C is another illustration of slash game play on a gaming device, according to one embodiment.
Figure 5D:
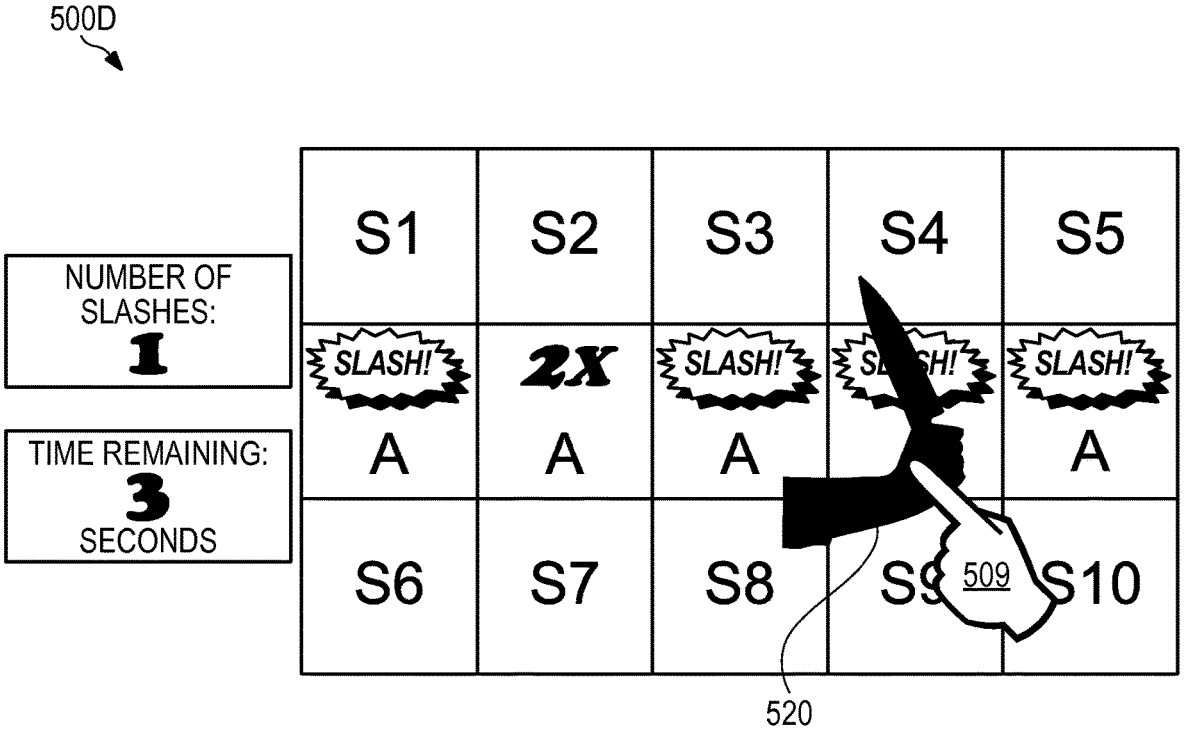
FIG. 5D is another illustration of slash game play on a gaming device, according to one embodiment.
Figure 5E:
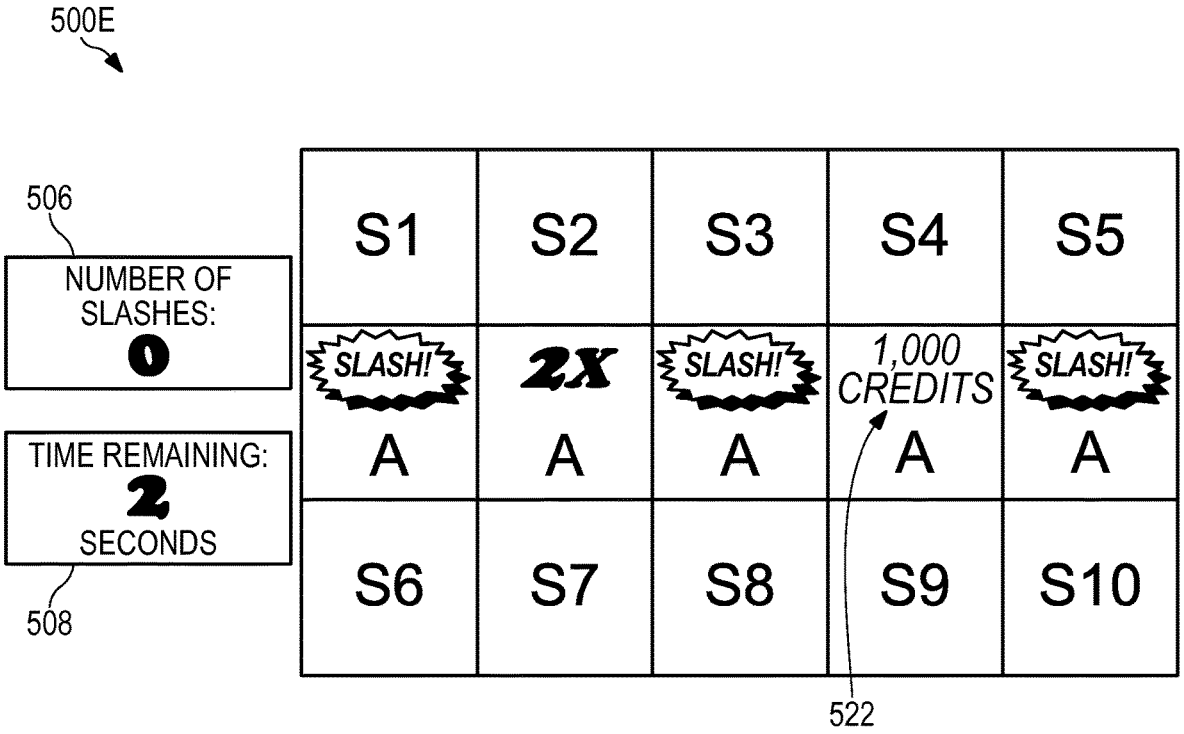
FIG. 5E is another illustration of slash game play on a gaming device, according to one embodiment.
Figure 5F:
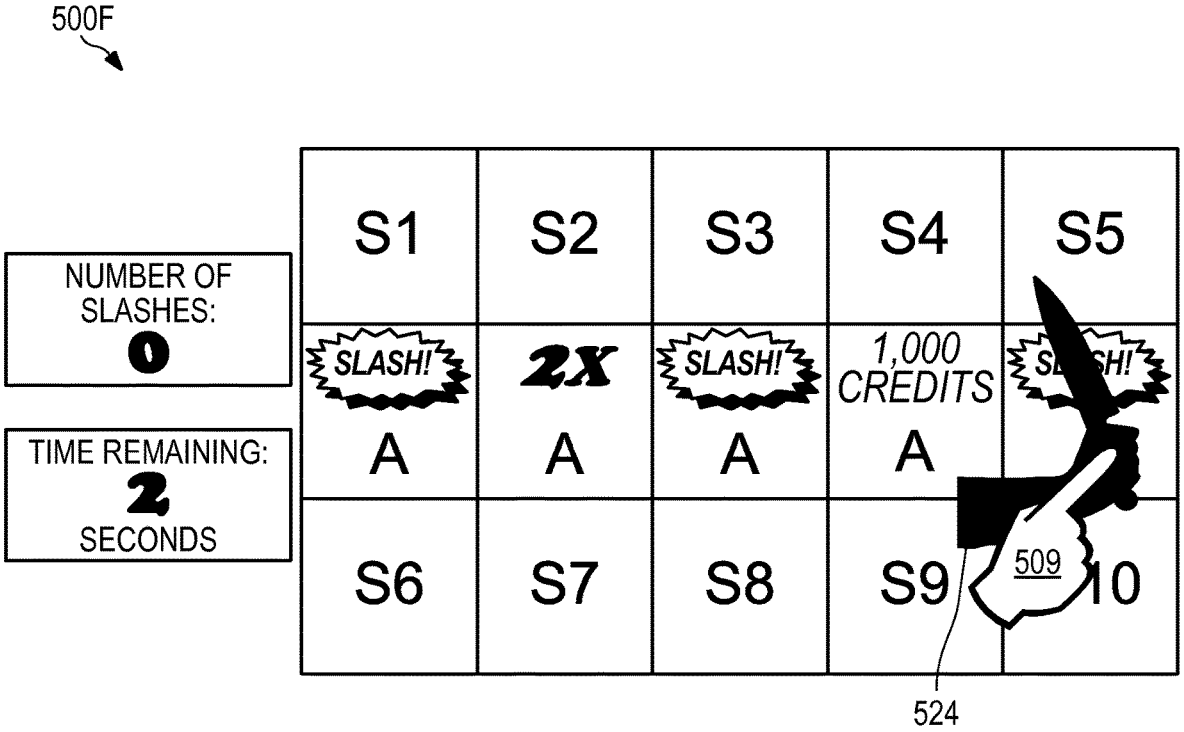
FIG. 5F is another illustration of slash game play on a gaming device, according to one embodiment.
Figure 5G:
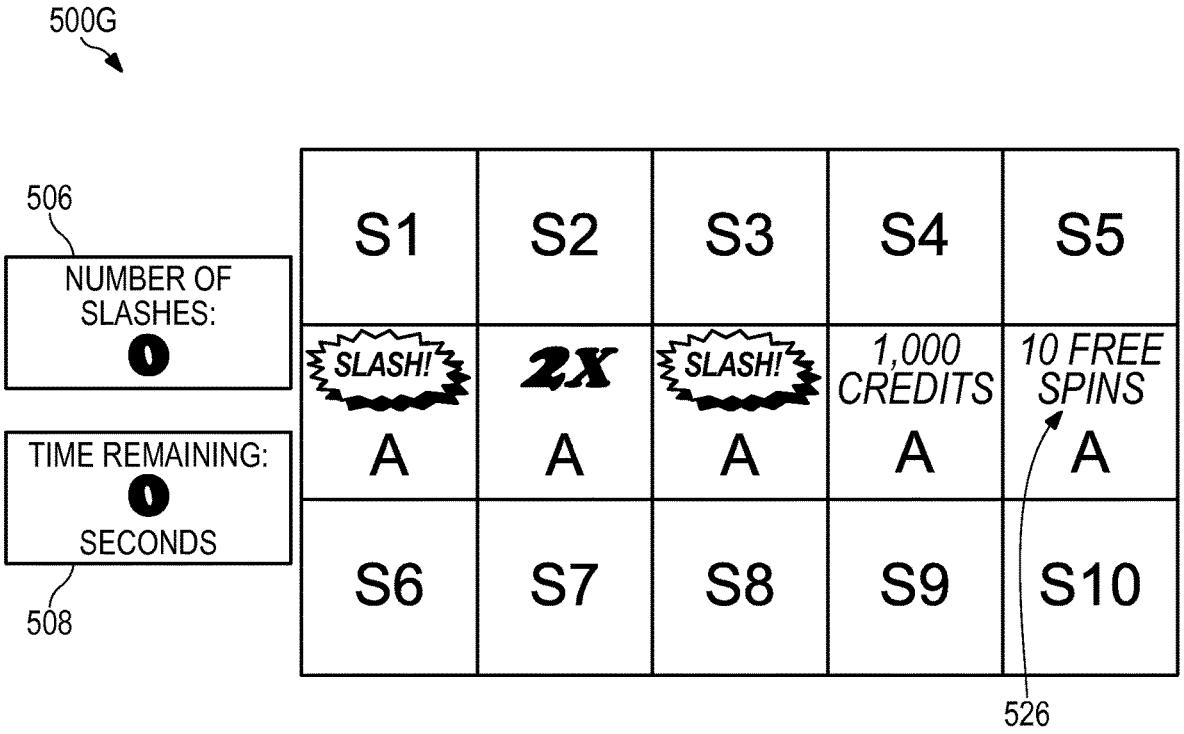
FIG. 5G is another illustration of slash game play on a gaming device, according to one embodiment.

In another example, the player via a firsthand image 509 (which may occur via one or more 3D gesturing inputs) slashes via a first slash image 516 into a first slashed symbol (e.g., row 2/column 2) (see FIG. 5B). After the player slashes the first slashed symbol (e.g., row 2/column 2), the player may have 1 slash left (as indicated by slash counter 506) and/or 3 seconds remaining (as indicated by slash timer 508). In this example, first slashed symbol (e.g., row 2/column 2) has transformed into a 2× multiplier (along with the original ace) (see FIG. 5C). In another example, the player via first hand image 509 may slash via a second slash image 520 into a second slashed symbol (e.g., row 2/column 4) (see FIG. 5D). In this example, second slashed symbol (e.g., row 2/column 4) has transformed into 1,000 credits (along with the original ace) (see FIG. 5E). In this example, the player may have 0 slashes left (as indicated by slash counter 506) and/or 2 seconds remaining (as indicated by slash timer 508). Therefore, it examples where the slash counter 506 is utilized the round would be over. However, in examples where the slash timer 508 is only used, there would be 2 seconds left in the round. In the slash timer 508 example, the player via first hand image 509 may slash via a third slash image 524 into a third slashed symbol (e.g., row 2/column 5) (see FIG. 5F). In this example, third slashed symbol (e.g., row 2/column 5) has transformed into 10 free spins (along with the original ace) (FIG. 5G). In this example, the player may have 0 slashes left (as indicated by slash counter 506) and/or 0 seconds remaining (as indicated by slash timer 508).

Figure 6A:
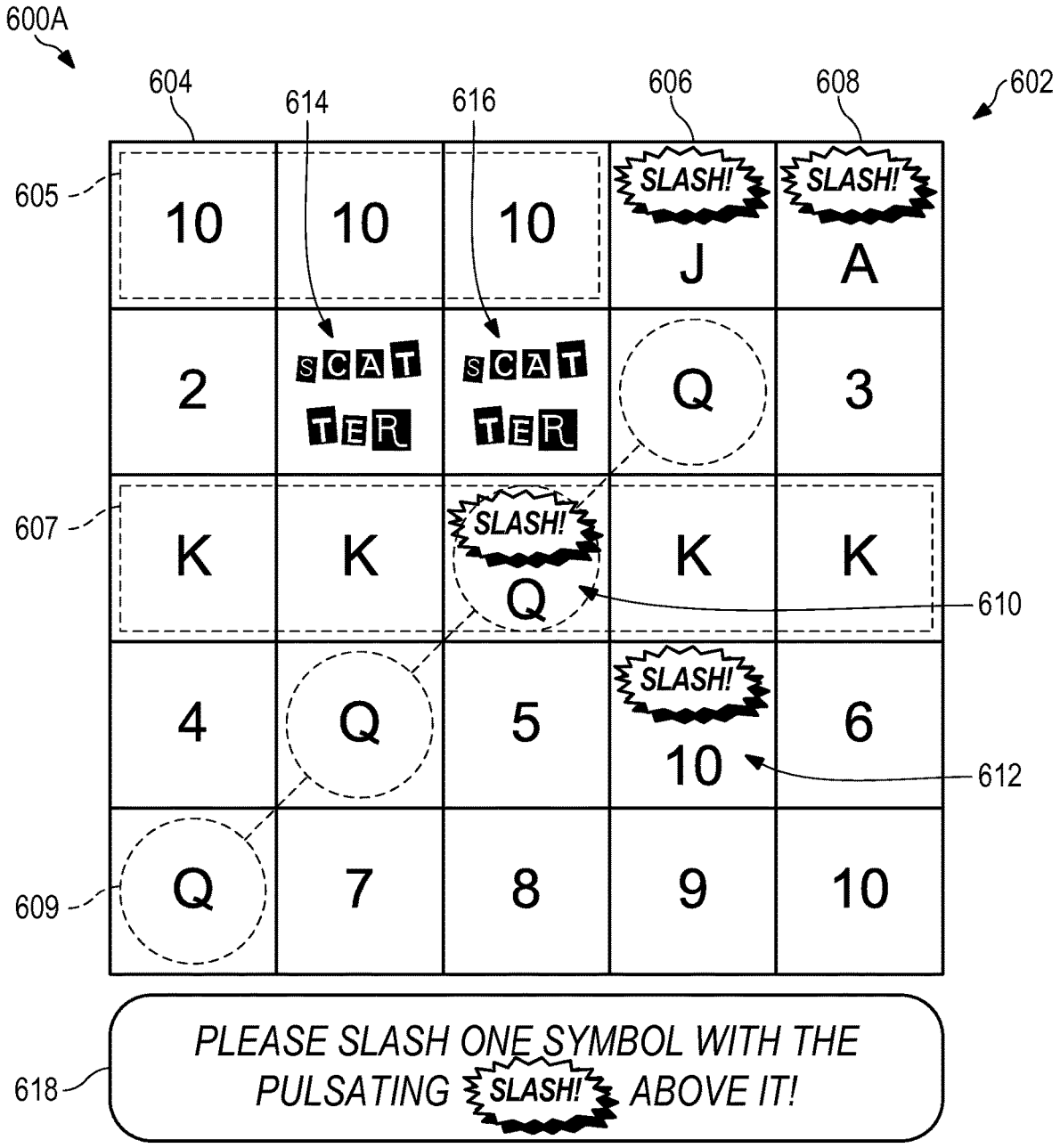
FIG. 6A is another illustration of slash game play on a gaming device, according to one embodiment.

In FIG. 6A, another illustration of slash game play on a gaming device is shown, according to one embodiment. A second image 600A may include a display 602, one or more reels 604, a first slashable symbol 606, a second slashable symbol 608, a third slashable symbol 610, a fourth slashable symbol 612, a first scatter 614, a second scatter 616, a message area 618, a first potential winning combination 605, a second potential winning combination 607, and a third potential winning combination 609. In this example, message area 618 may state "PLEASE SLASH ONE SYMBOL WITH THE PULSATING SLASH! ABOVE IT!"

In another example, first potential winning combination 605 includes 3 ten symbols on a pay line, however, at least 4 ten symbols are required on a pay line to obtain a winning combination. In another example, second potential winning combination 607 includes 4 king symbols on a pay line; however, no winning combination is created when there is a gap between the 4 king symbols. In another example, third potential winning combination 609 includes 4 queen symbols on a pay line which does generate a winning combination; however, a greater payout can be achieved when there are 5 queens in a row.

Figure 6B:
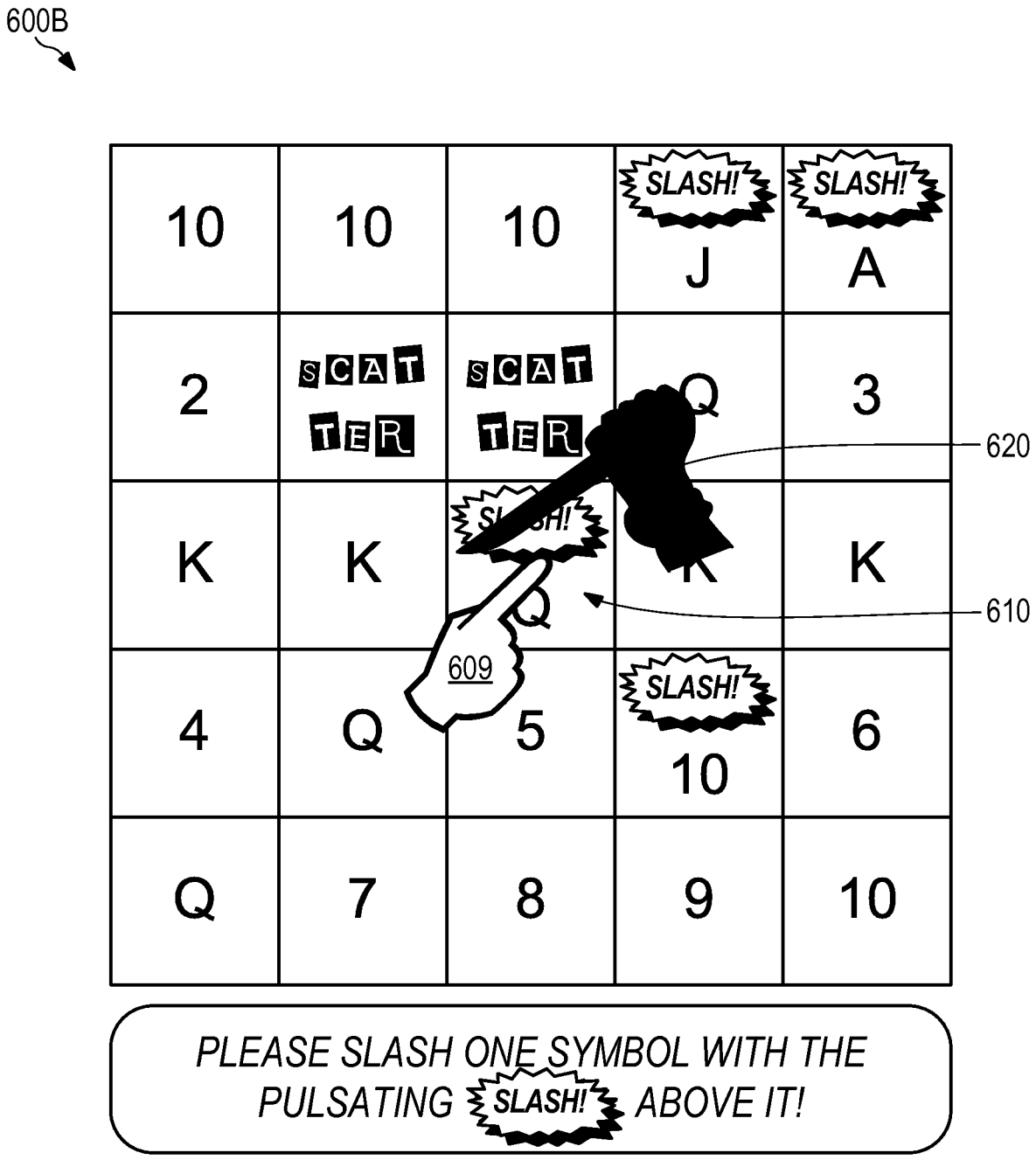
FIG. 6B is another illustration of slash game play on a gaming device, according to one embodiment.
Figure 6C:
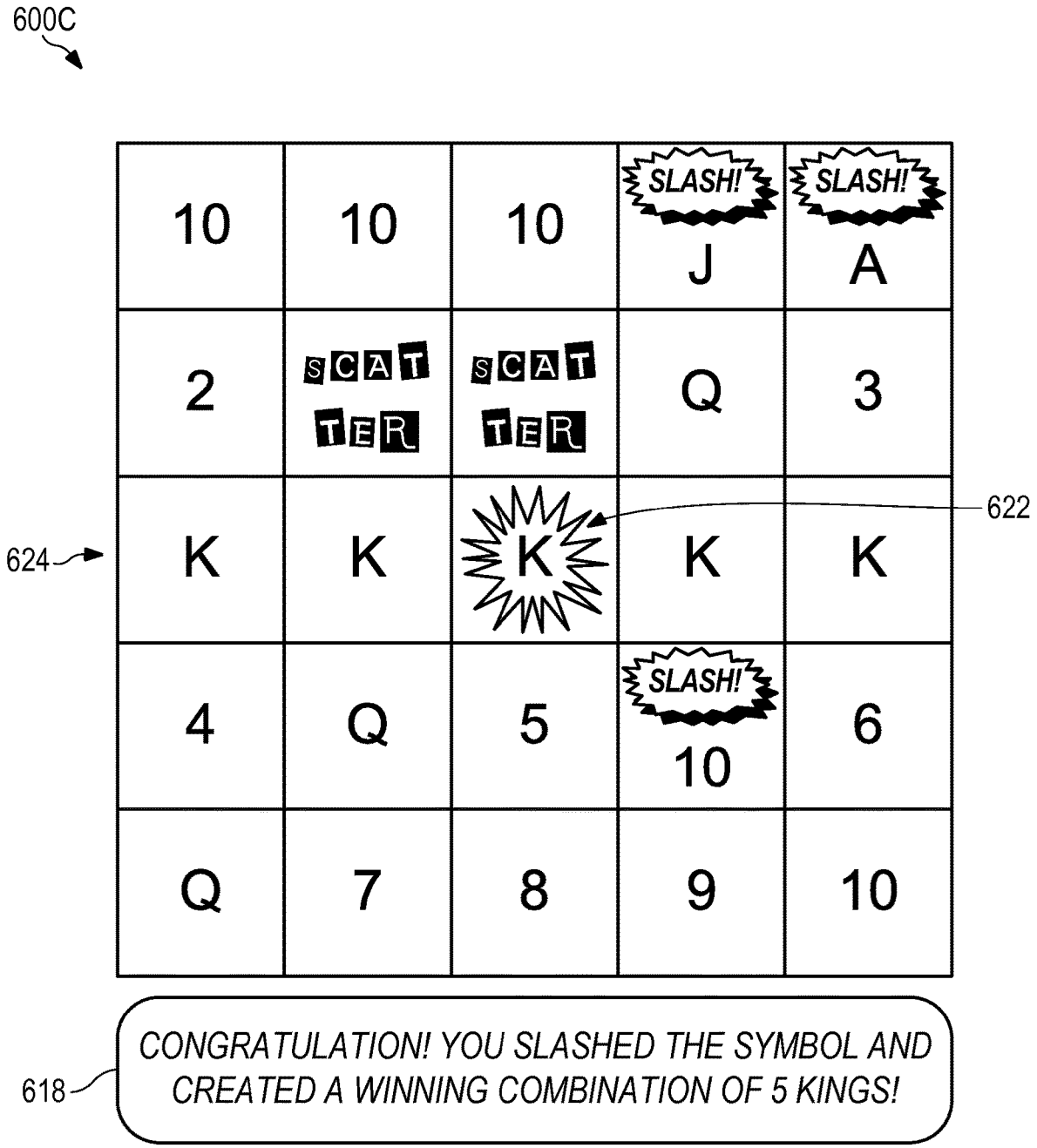
FIG. 6C is another illustration of slash game play on a gaming device, according to one embodiment.

In one example shown in FIG. 6B, the player via a firsthand image 609 and/or via a first slashing image 620 may slash third slashable symbol 610. In this example, third slashable symbol 610 may transform into a king slashed symbol 622 (see FIG. 6C). This may generate a new winning combination of 5 kings on a first pay line 624. Further, the 4 queen combination may have already been paid out. Therefore, the 5 kings winning combination is in addition to the already won prize. In another example, the 5 kings winning combination takes the place of the 4 queen winning combination—therefore, the 4 queen winning combination was not paid out. Message area 618 may state "CONGRADULATIONS! YOU SLASHED THE SYMBOL AND CREATED A WINNING COMBINATION OF 5 KINGS!"

Figure 6D:
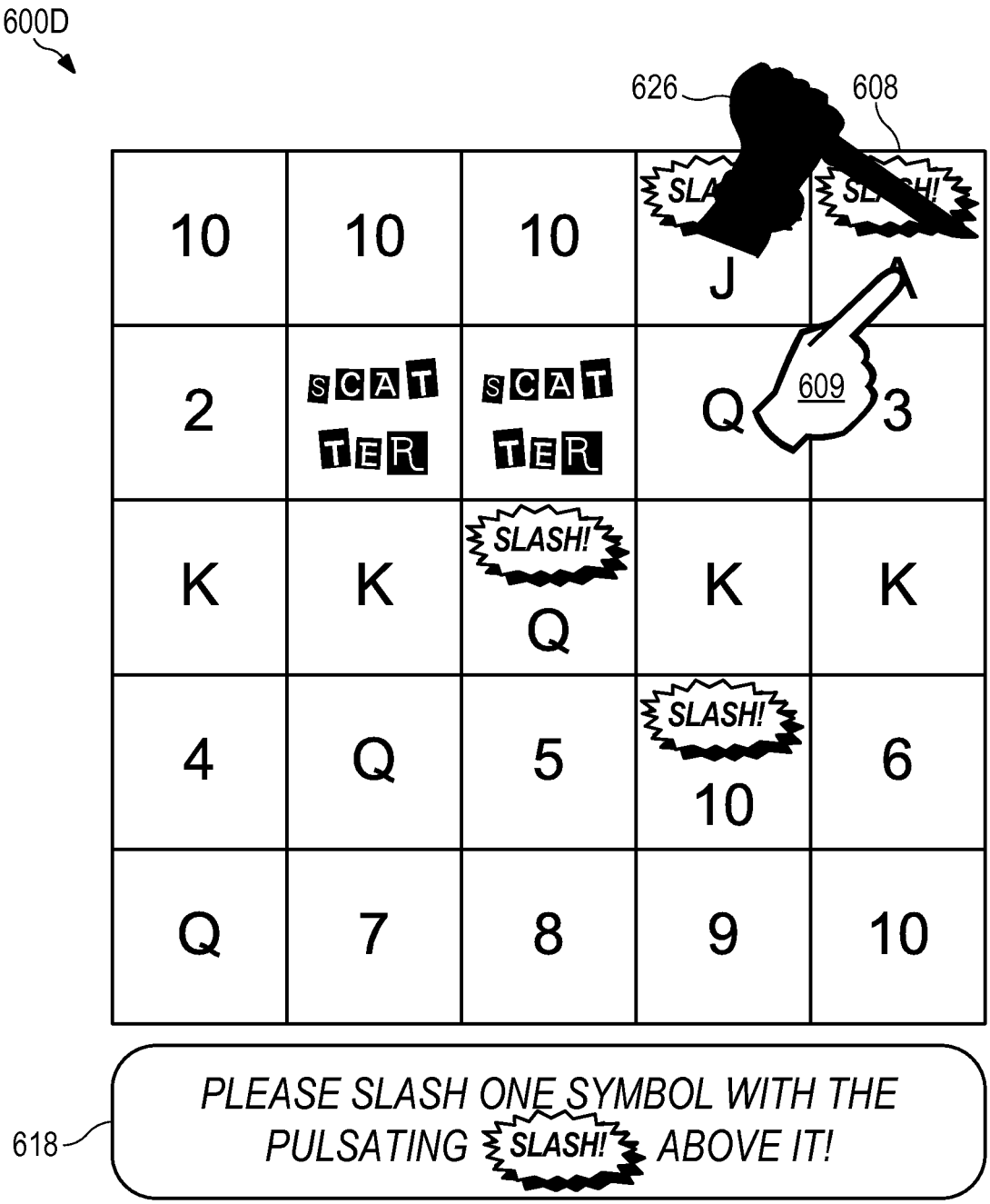
FIG. 6D is another illustration of slash game play on a gaming device, according to one embodiment.
Figure 6E:
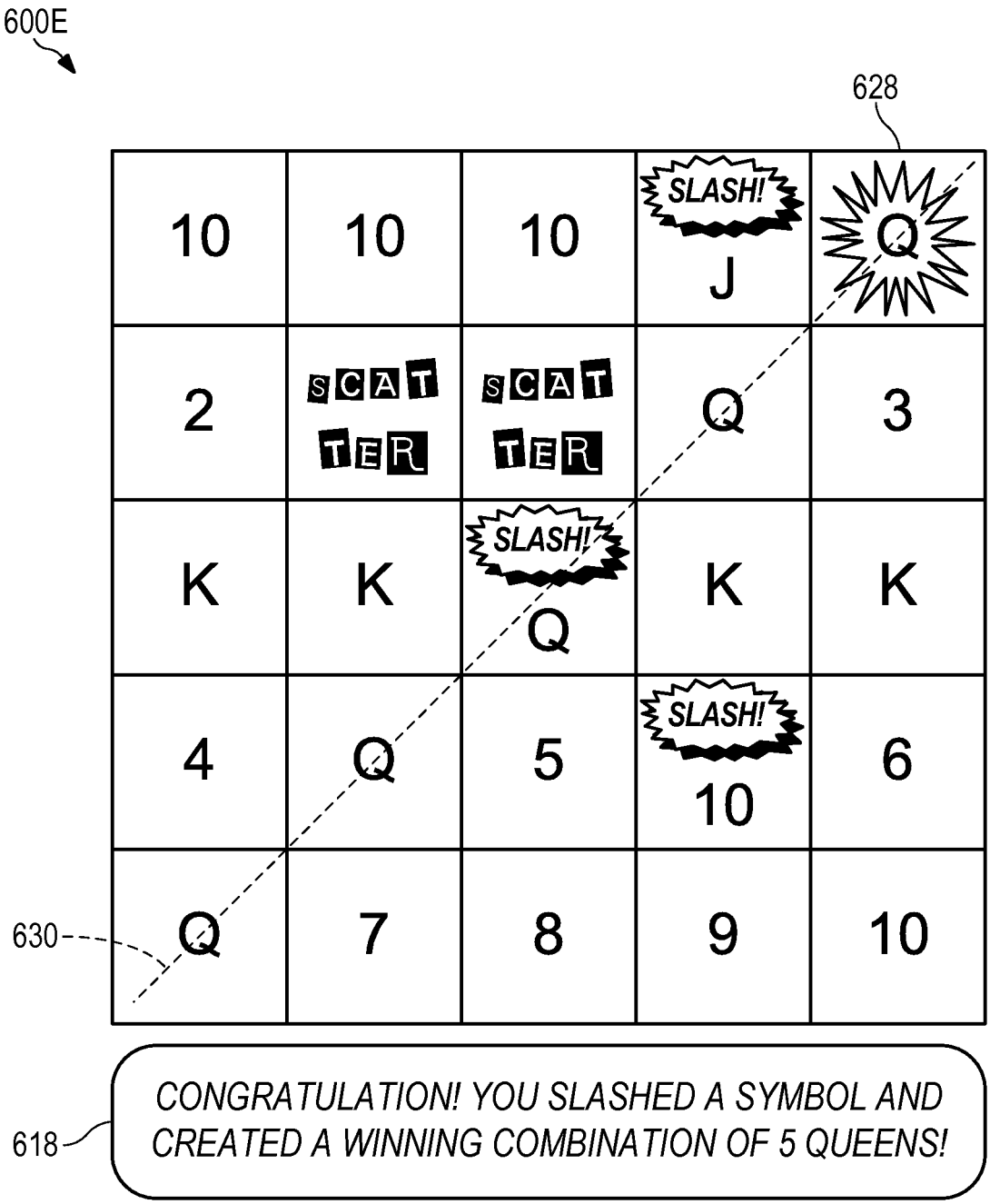
FIG. 6E is another illustration of slash game play on a gaming device, according to one embodiment.

In another example shown in FIG. 6D, the player may slash second slashable symbol 608 In this example, second slashable symbol 608 may transform into a queen slashed symbol 628 (see FIG. 6E). This may generate a new winning combination of 5 queens on a second pay line 630. Further, the 4 queen combination may have already been paid out. Therefore, the 5 queens winning combination is in addition to the already won prize. In another example, the 5 queens winning combination takes the place of the 4 queen winning combination—therefore, the 4 queen winning combination was not paid out. Message area 618 may state "CONGRATULATIONS! YOU SLASHED A SYMBOL AND CREATED A WINNING COMBINATION OF 5 QUEENS!"

Figure 6F:
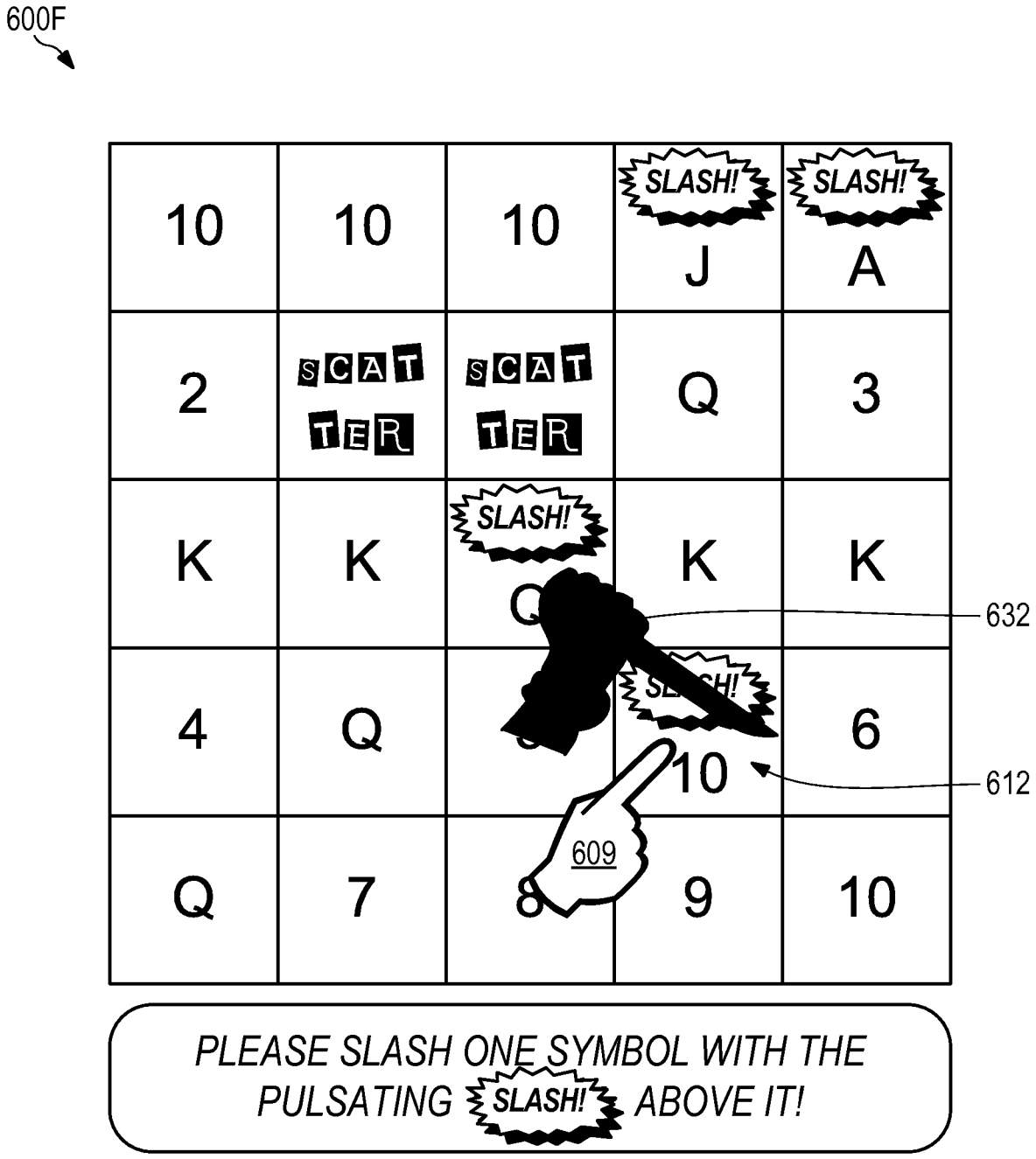
FIG. 6F is another illustration of slash game play on a gaming device, according to one embodiment.
Figure 6G:
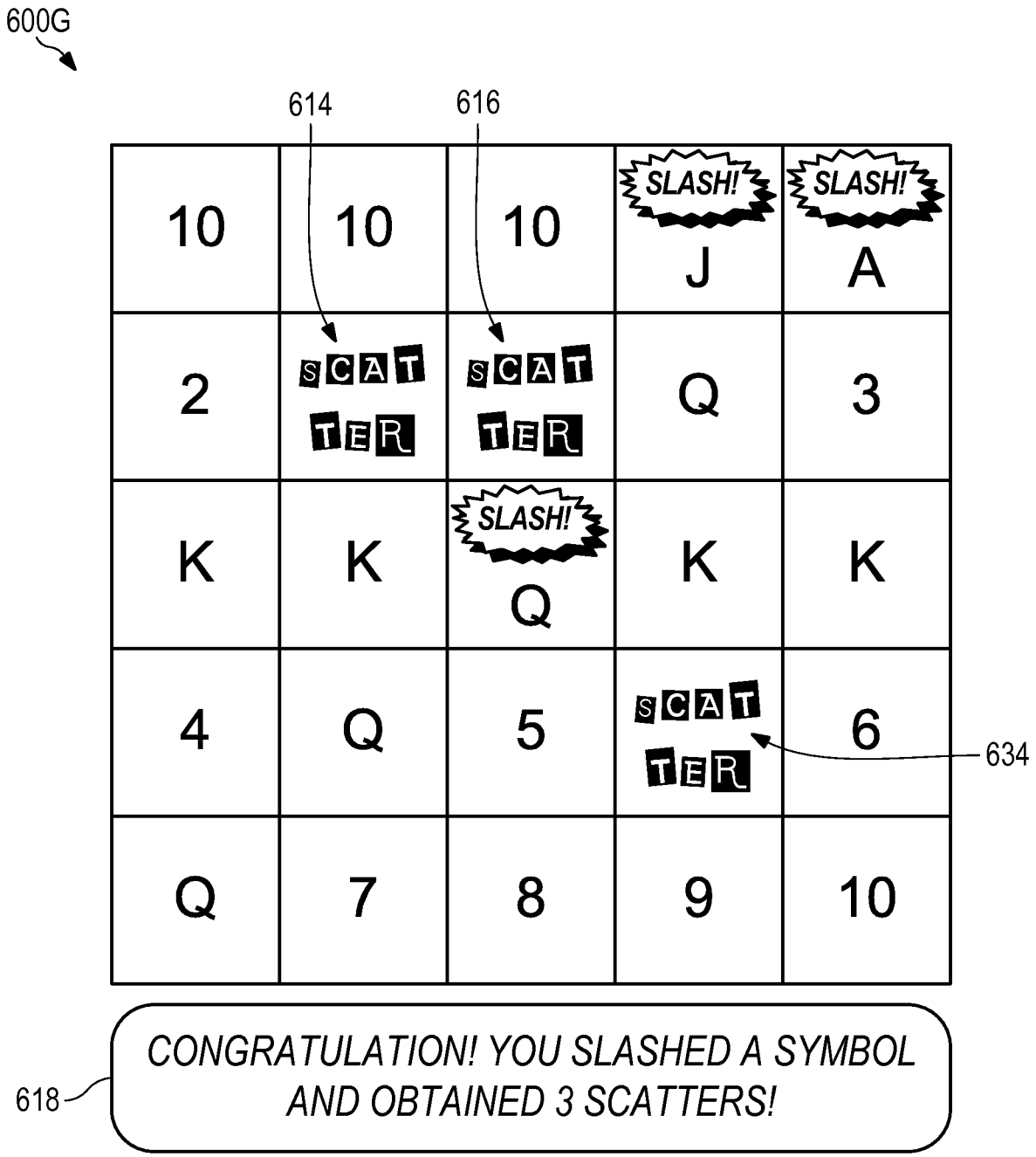
FIG. 6G is another illustration of slash game play on a gaming device, according to one embodiment.

In another example shown in FIG. 6F, the player may slash third slashable symbol 610. In this example, third slashable symbol 610 may transform into a scatter slashed symbol 634 (see FIG. 6G). This may generate a new winning combination of 3 scatter symbols. Further, the 4 queen combination may have already been paid out. Therefore, the 3 scatters winning combination is in addition to the already won prize. In another example, the 3 scatters winning combination takes the place of the 4 queen winning combination—therefore, the 4 queen winning combination was not paid out. Message area 618 may state "CONGRATULATIONS! YOU SLASHED A SYMBOL AND OBTAINED 3 SCATTERS!"

Figure 6H:
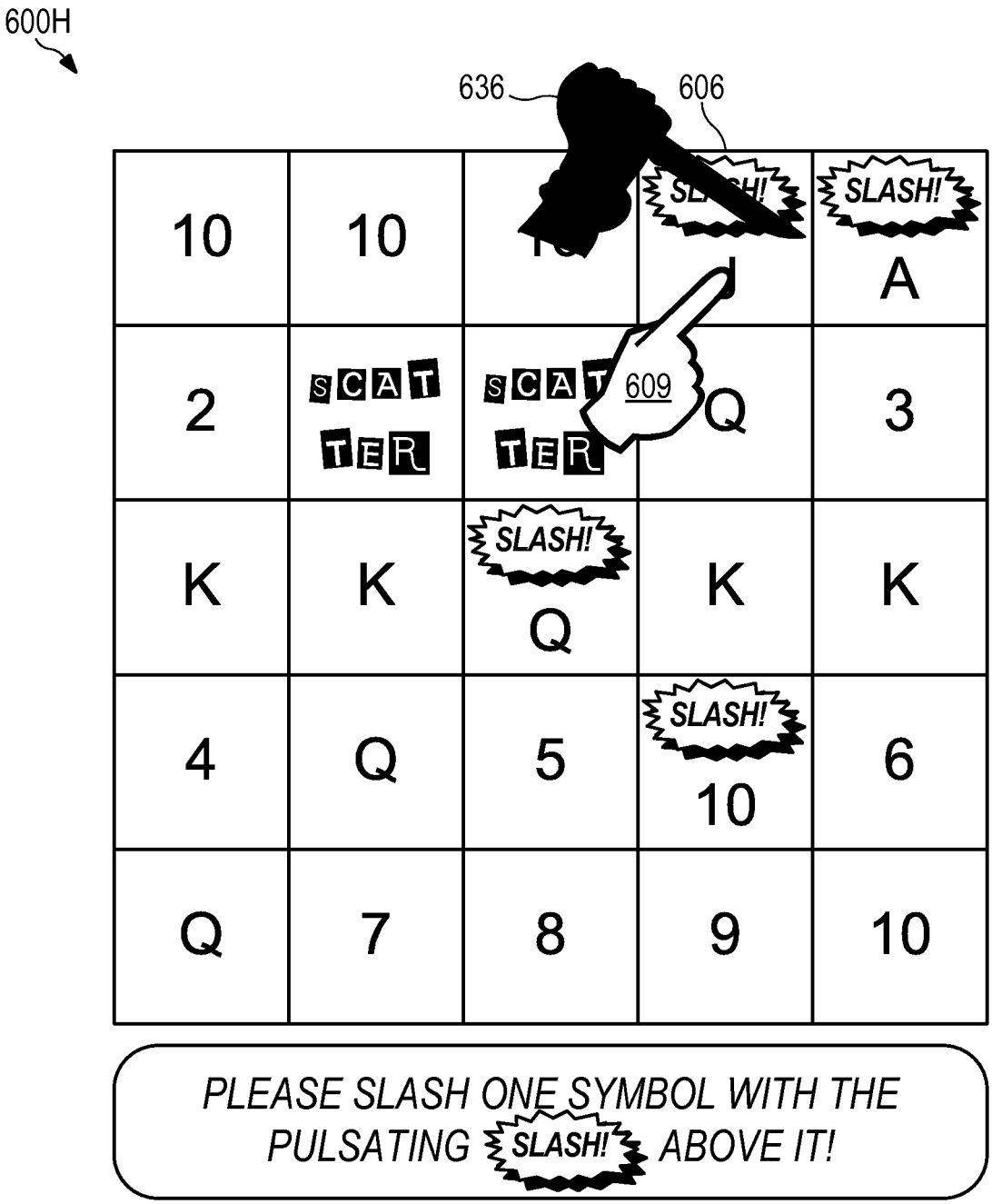
FIG. 6H is another illustration of slash game play on a gaming device, according to one embodiment.
Figure 6J:
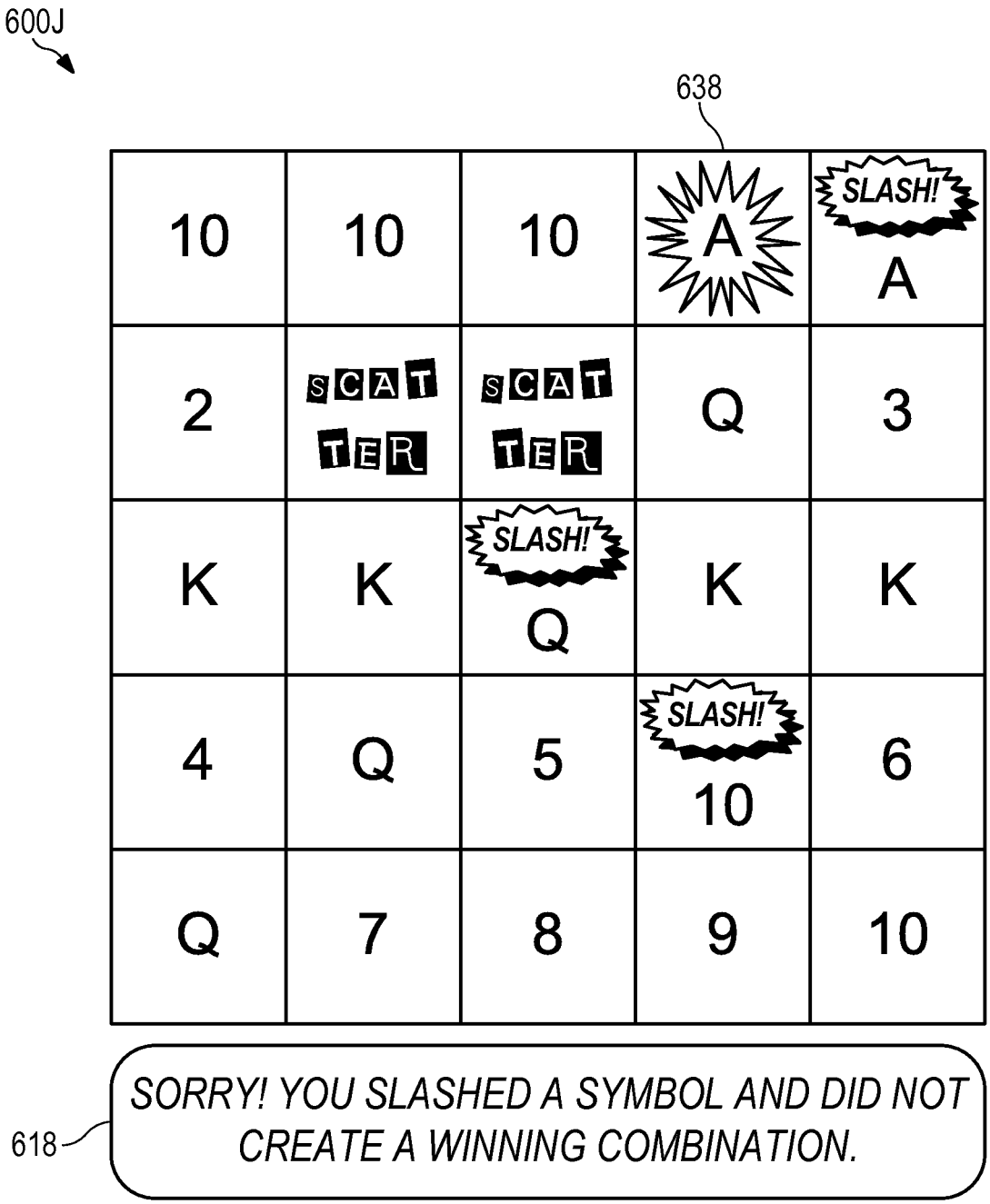
FIG. 6J is another illustration of slash game play on a gaming device, according to one embodiment.

In another example shown in FIG. 6H, the player may slash first slashable symbol 606. In this example, first slashable symbol 606 may transform into an ace slashed symbol (see FIG. 6J). This may not generate any new winning combinations. Therefore, only the 4 queen combination may have been paid out.

Figure 6K:
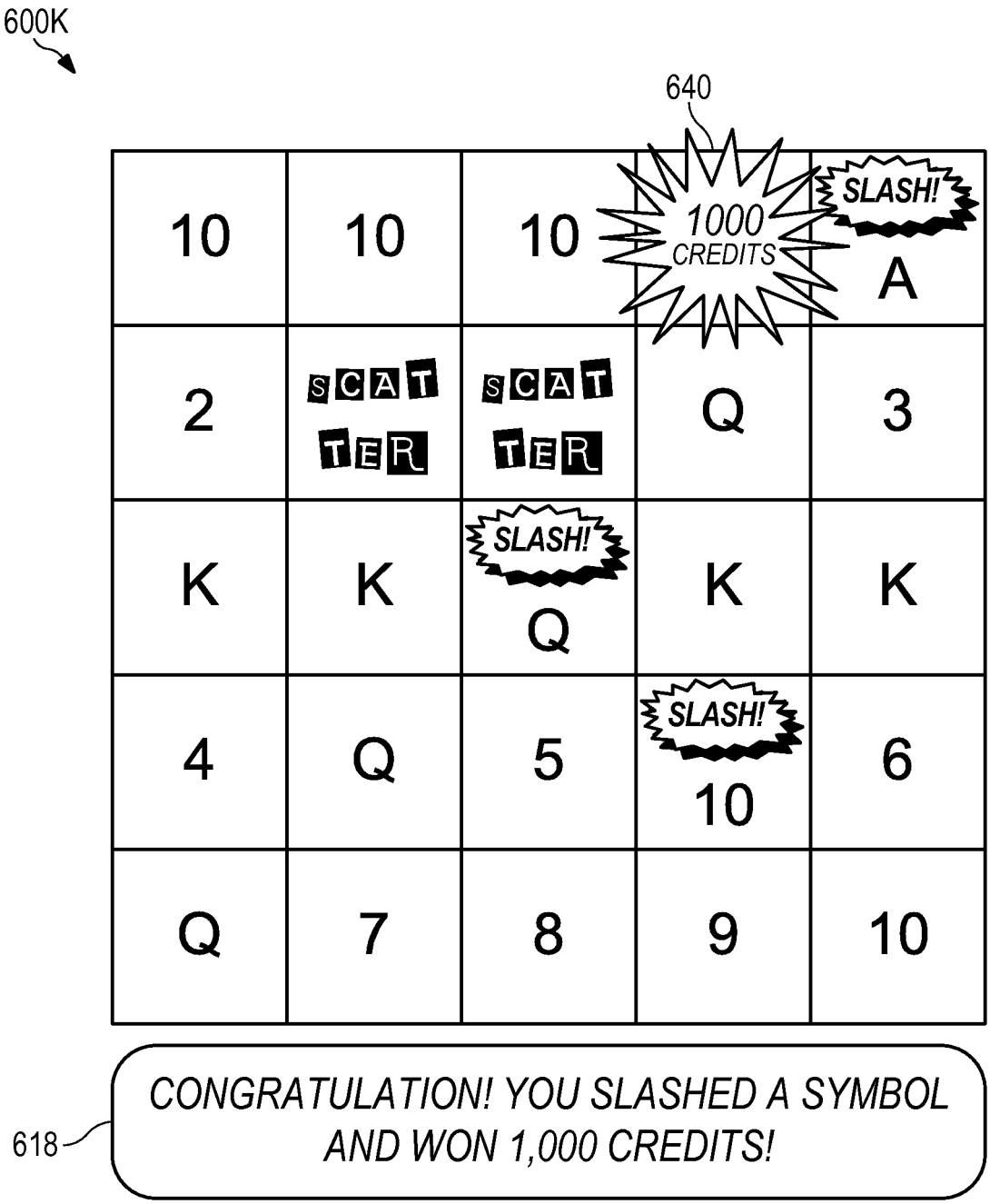
FIG. 6K is another illustration of slash game play on a gaming device, according to one embodiment.

In FIG. 6K, another illustration of slash game play on a gaming device is shown, according to one embodiment. A third image 600K may show that first slashable symbol 606 has been slashed by the player and transformed into a first credit amount and/or image 640 (e.g., 1,000 credits, 10,000 credits, and/or any other number (e.g., 1–n)). Message area 618 may state "CONGRATULATIONS! YOU SLASHED A SYMBOL AND WON 1,000 CREDITS!"

Figure 6L:
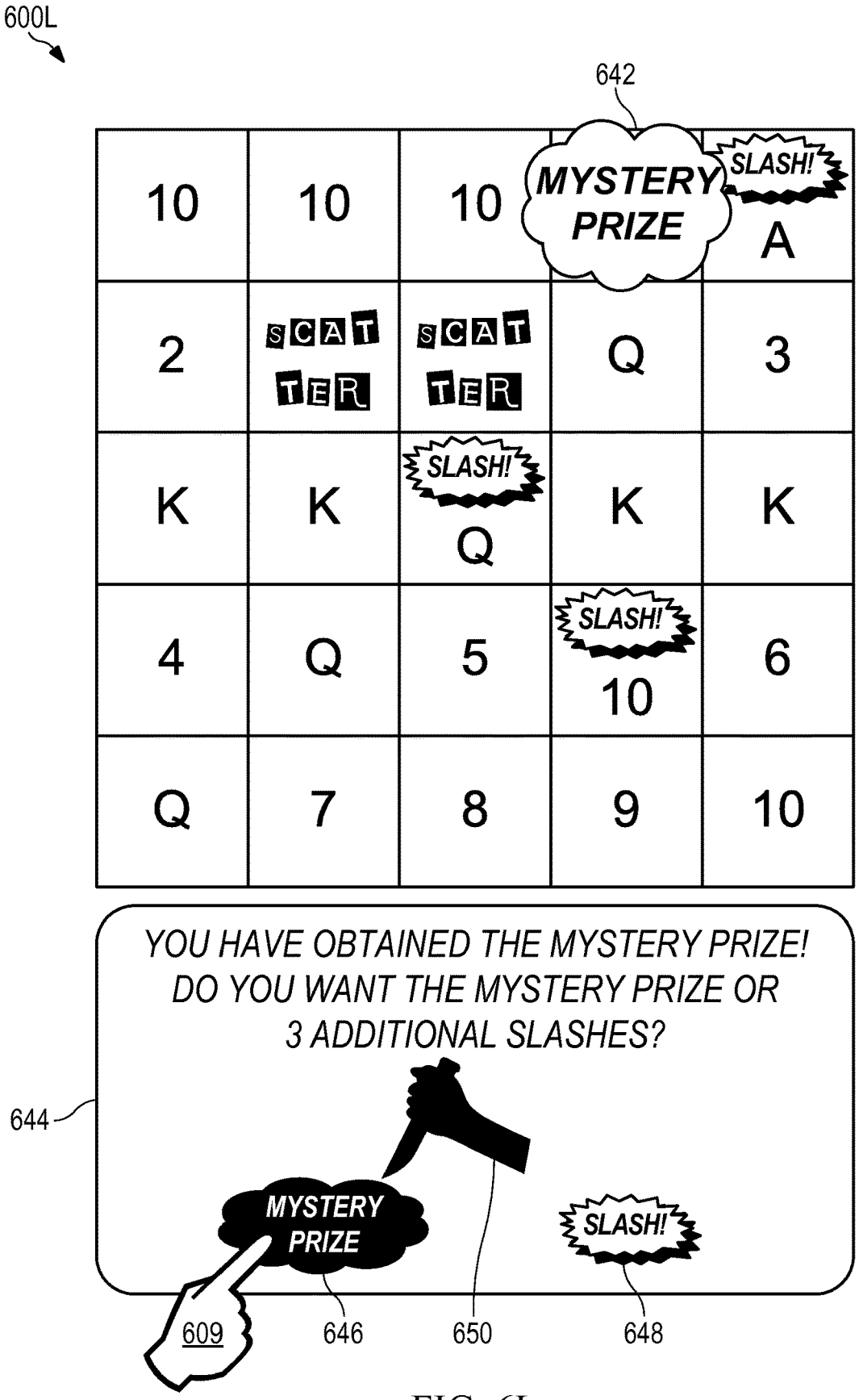
FIG. 6L is another illustration of slash game play on a gaming device, according to one embodiment.
Figure 6M:
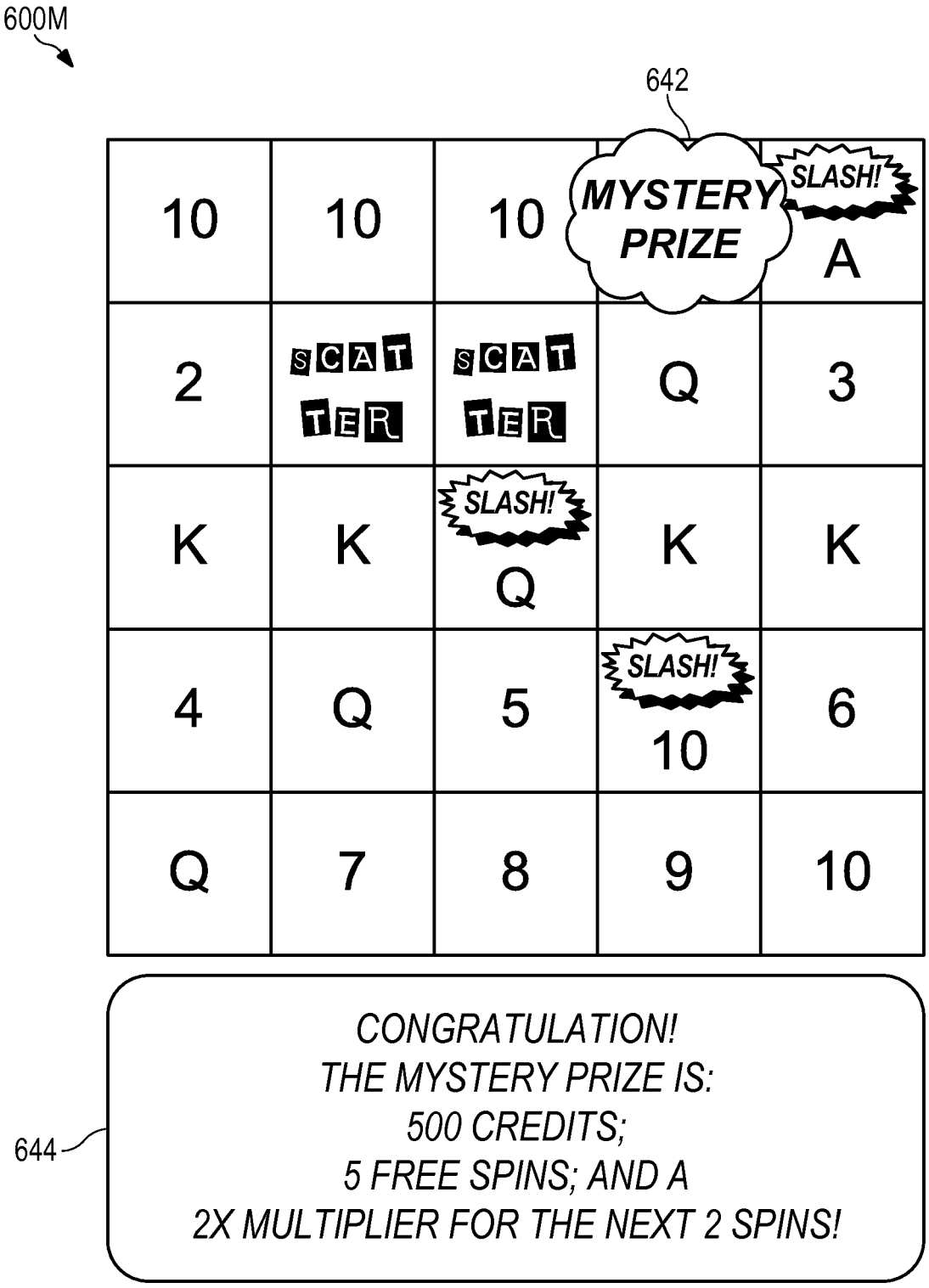
FIG. 6M is another illustration of slash game play on a gaming device, according to one embodiment.

In FIG. 6L, another illustration of slash game play on a gaming device is shown, according to one embodiment. In this example, the player may slash first slashable symbol 606. In this example, first slashable symbol 606 may transform into a mystery symbol 642. This may generate one or more options for the player. For example, a message area 644 may allow the player to selection a mystery prize, additional slashes, any other prize, and/or any combination thereof. In this example, the player has elected to select a mystery prize 646 via a third slashing image 650. The player could have also selected additional slashes option 648. Message area 644 may state "YOU HAVE OBTAINED THE MYSTERY PRIZE! DO YOU WANT THE MYSTERY PRIZE OR 3 ADDITIONAL SLASHES?" In this example, the player selected the mystery prize 646 which can be seen in FIG. 6M. In FIG. 6M, message area 644 may state "CONGRATULATION! THE MYSTERY PRIZE IS: 500 CREDITS; 5 FREE SPINS; AND A 2× MULTIPLIER FOR THE NEXT 2 SPINS!"

Figure 6N:
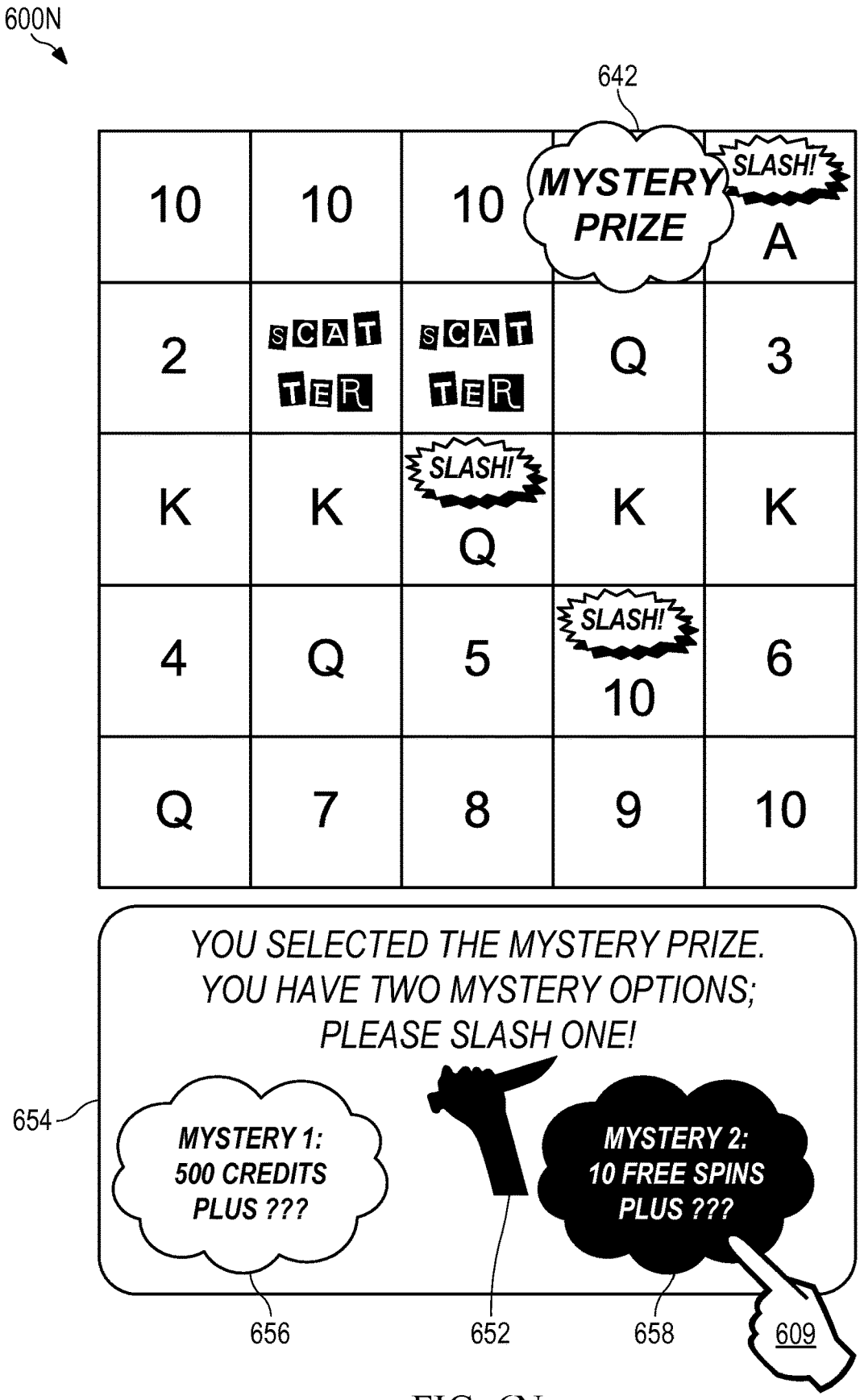
FIG. 6N is another illustration of slash game play on a gaming device, according to one embodiment.

In FIG. 6N, another illustration of slash game play on a gaming device is shown, according to one embodiment. In this example, the player has selected the mystery prize. In this example, the player may have more than one mystery prize options. In this example, a first mystery prize (reference number 656) is 500 credits plus some unknown prize (which will be revealed once the option is selected). In another example, a second mystery prize (reference number 658) is 10 free spins plus some unknown prize (which will be revealed once the option is selected). In these examples, some portion of the mystery prize is known and some portion of the mystery prize is unknown.

Figure 7A:
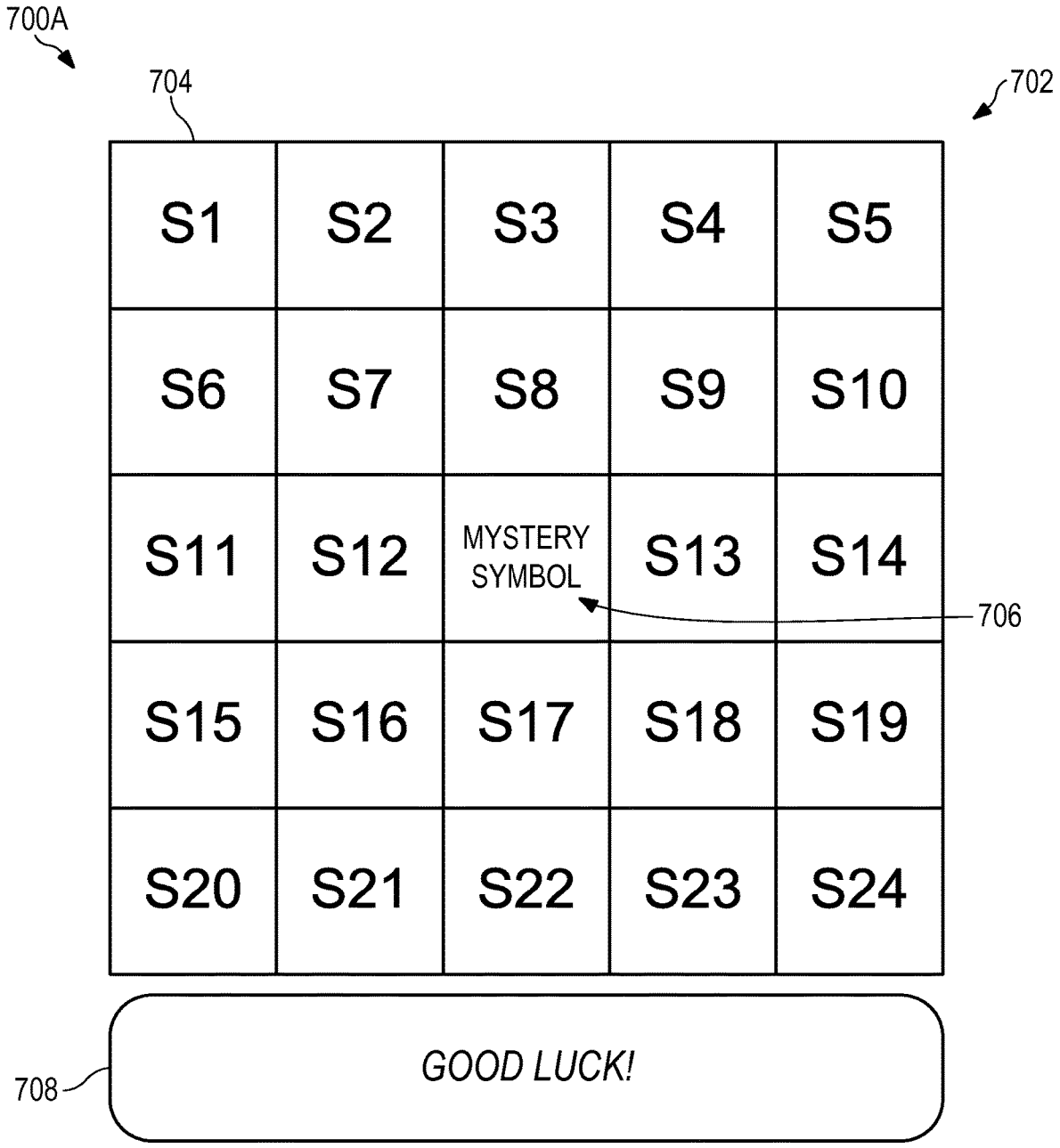
FIG. 7A is another illustration of slash game play on a gaming device, according to one embodiment.
Figure 7B:
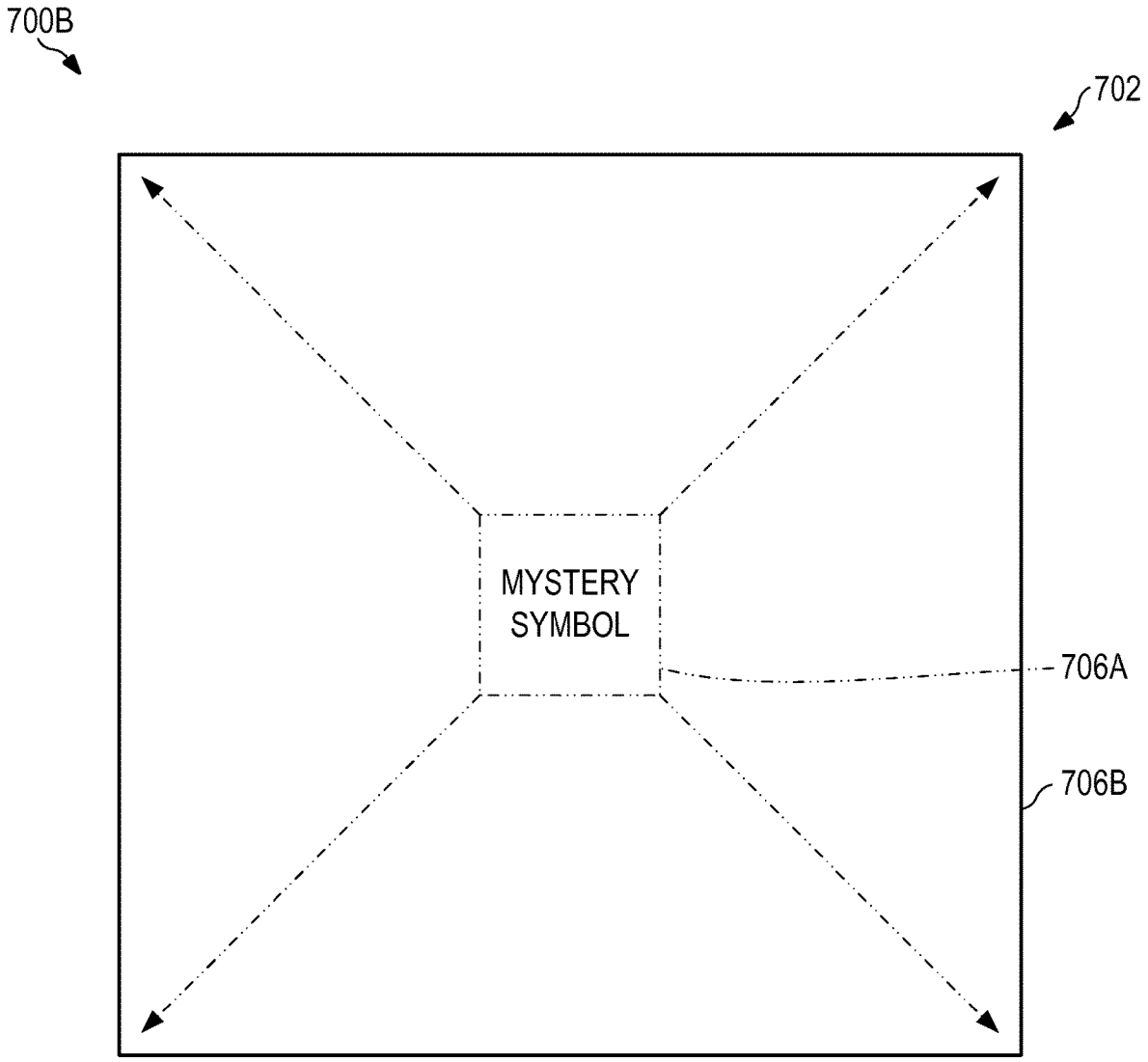
FIG. 7B is another illustration of slash game play on a gaming device, according to one embodiment.

In FIG. 7A, another illustration of slash game play on a gaming device is shown, according to one embodiment. A fourth image 700A may include a display 702, one or more reels 704, a mystery symbol 706, and a message area 708. In one example shown in FIG. 7B, the player selects mystery symbol 706 which expands to a full screen mode as can be seen in reference numbers 706A and 706B.

Figure 7C:
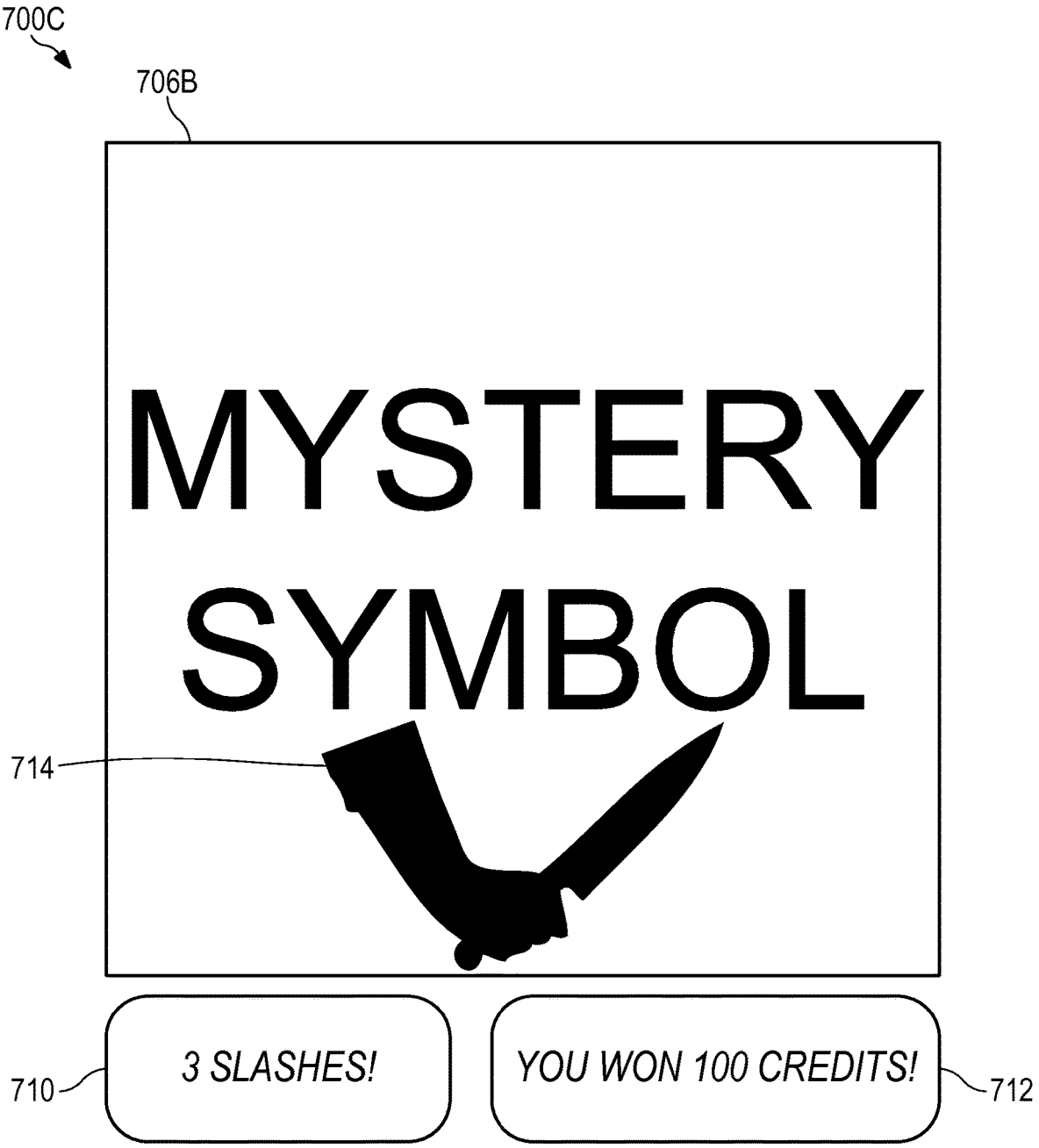
FIG. 7C is another illustration of slash game play on a gaming device, according to one embodiment.
Figure 7D:
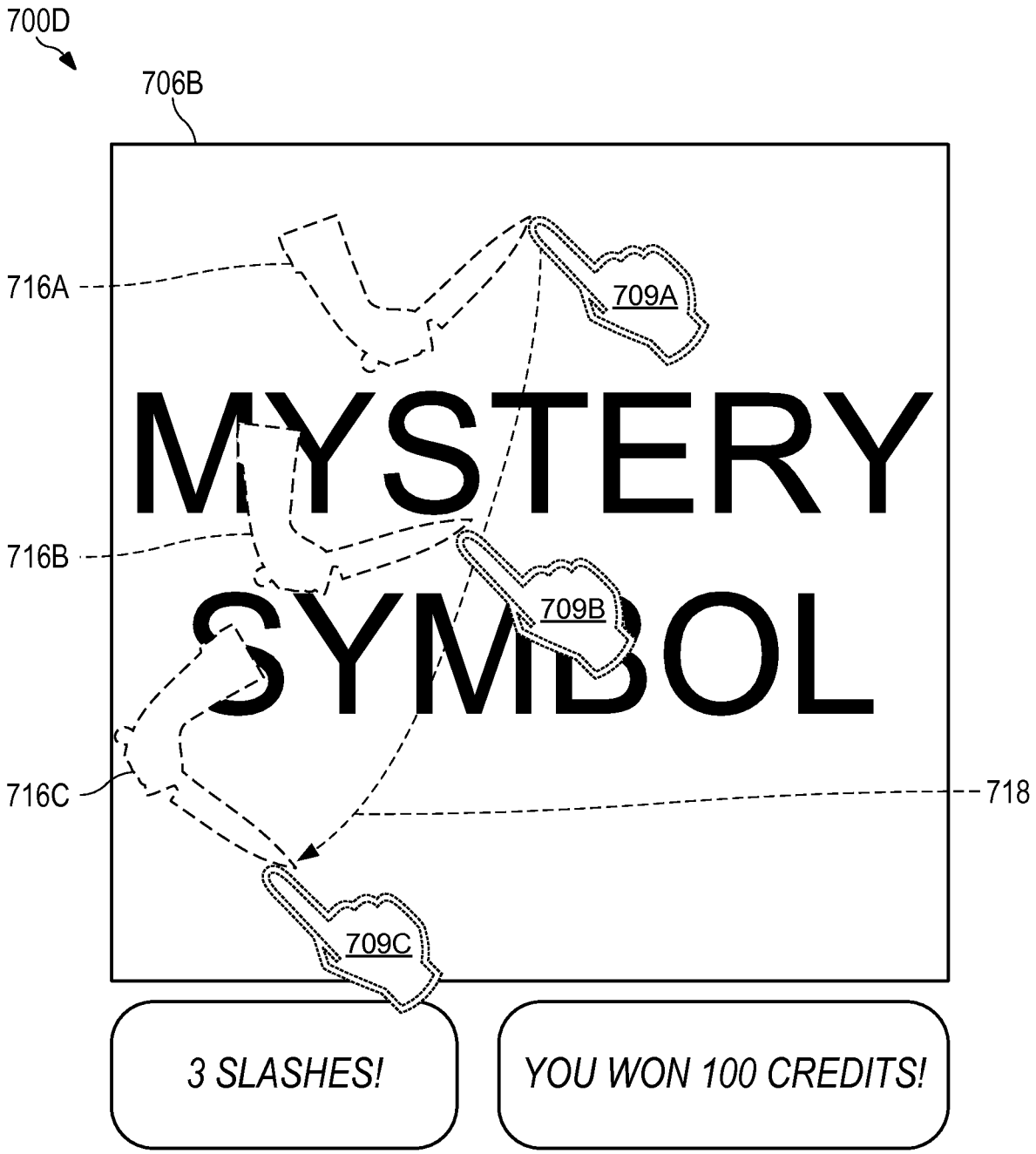
FIG. 7D is another illustration of slash game play on a gaming device, according to one embodiment.

In this example, the mystery symbol is a full screen image with a first slashing image 714. In this example seen in FIG. 7C, the player may have one or more input options including a slashing option 710, a credit option 715, a prize option, any other item of value option, and/or any combination thereof. In one example seen in FIG. 7D, the player has elected slashing option 710 which includes any number (e.g., 1–N) of slashes (in this example there are 3 slashes). In this example, the player has implemented a first slash 716A, a second slash 716B, and a third slash 716C via a first slashing path 718. In this example, the slashing generated a winning output of 100 credits.

Figure 7E:
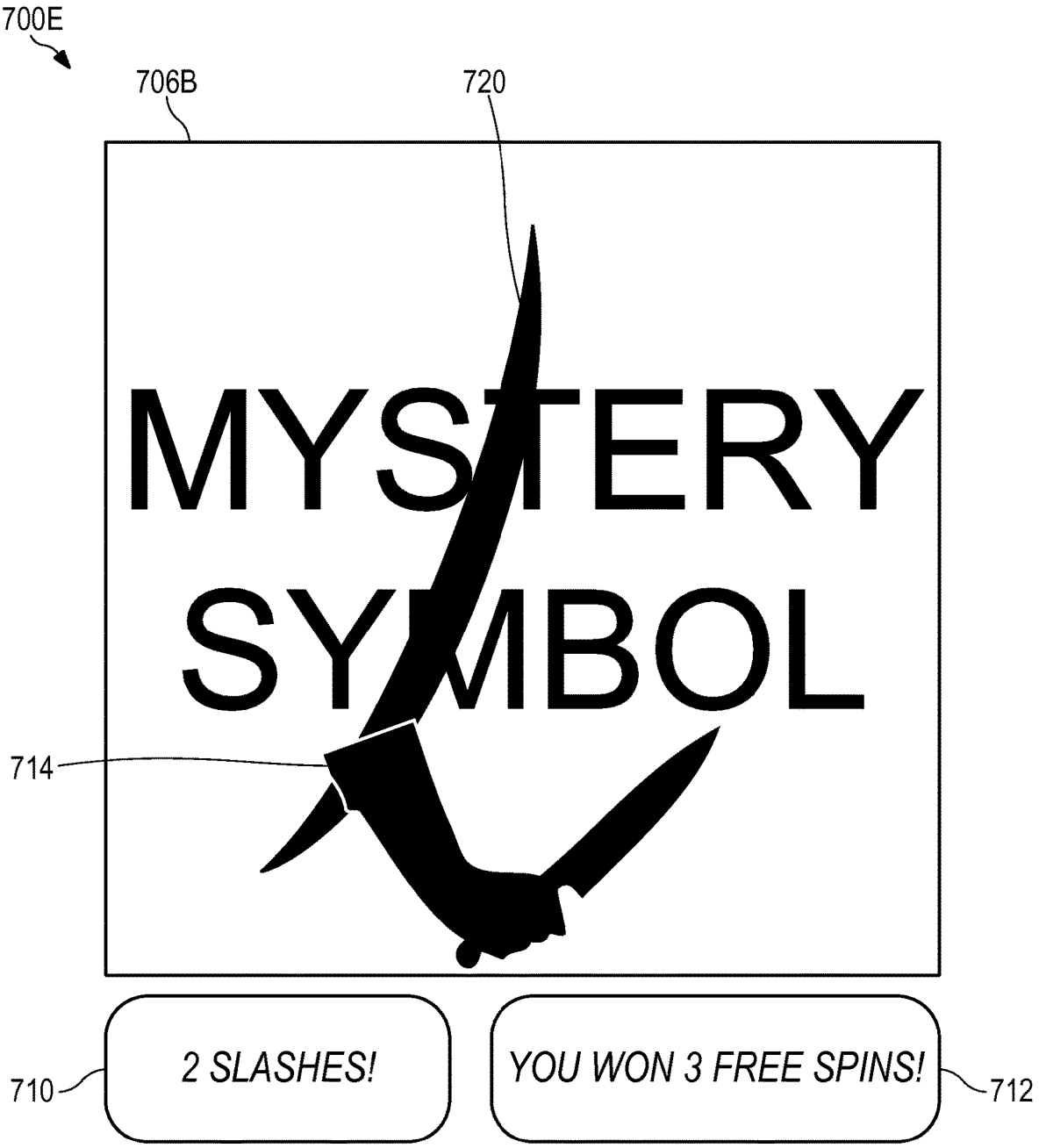
FIG. 7E is another illustration of slash game play on a gaming device, according to one embodiment.
Figure 7F:
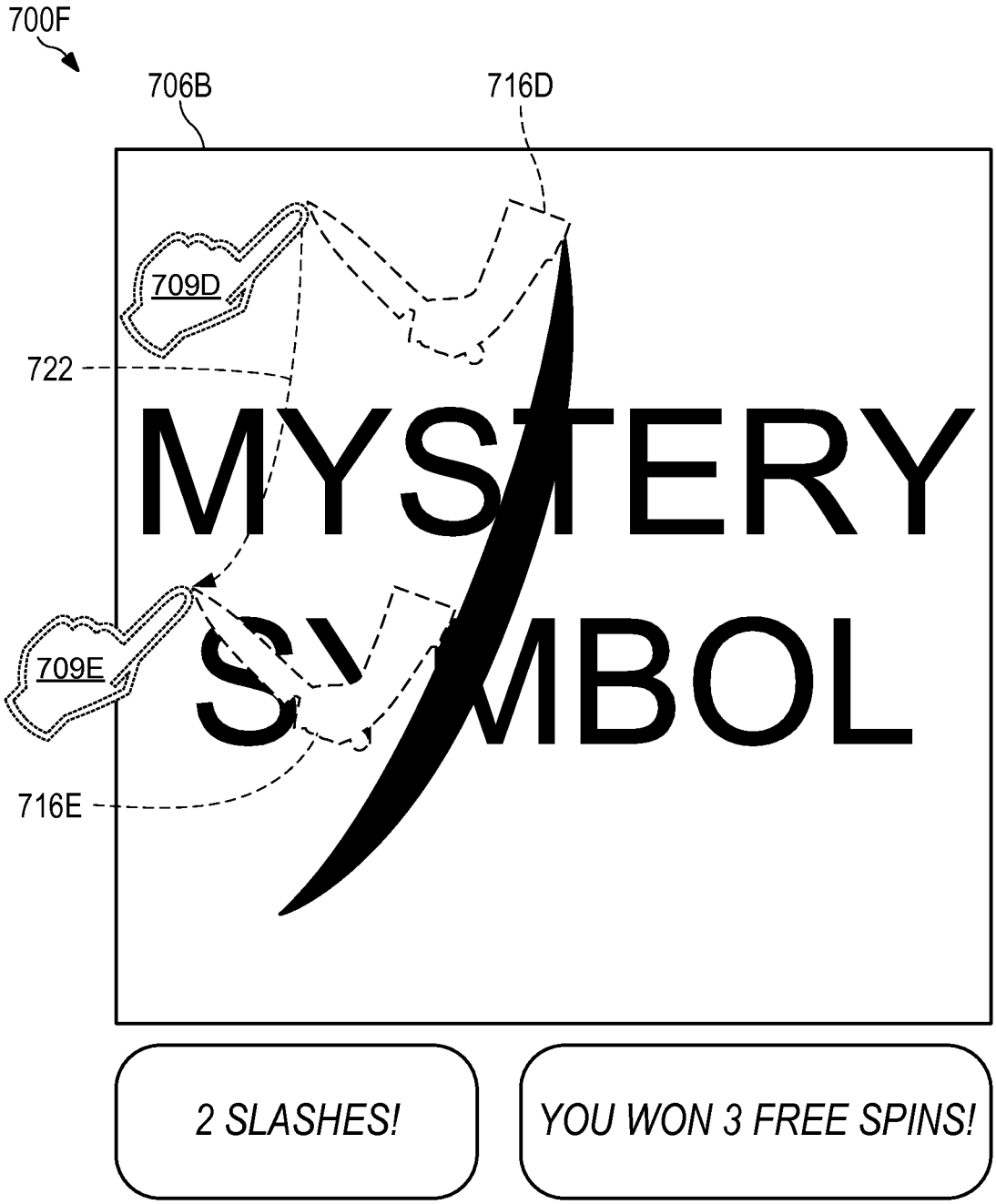
FIG. 7F is another illustration of slash game play on a gaming device, according to one embodiment.

In FIG. 7E, another illustration of slash game play on a gaming device is shown, according to one embodiment. In this example, the player has already slashed at the mystery symbol but the mystery symbol may have multiple levels which can be reached by continuing to slash at the object. In this example, a second slash image 720 was generated by a slashing input which generated 3 free spins. In another example shown in FIG. 7F, second slash image 720 may relate to a first slashing part 716D and a second slashing part 716E.

Figure 7G:
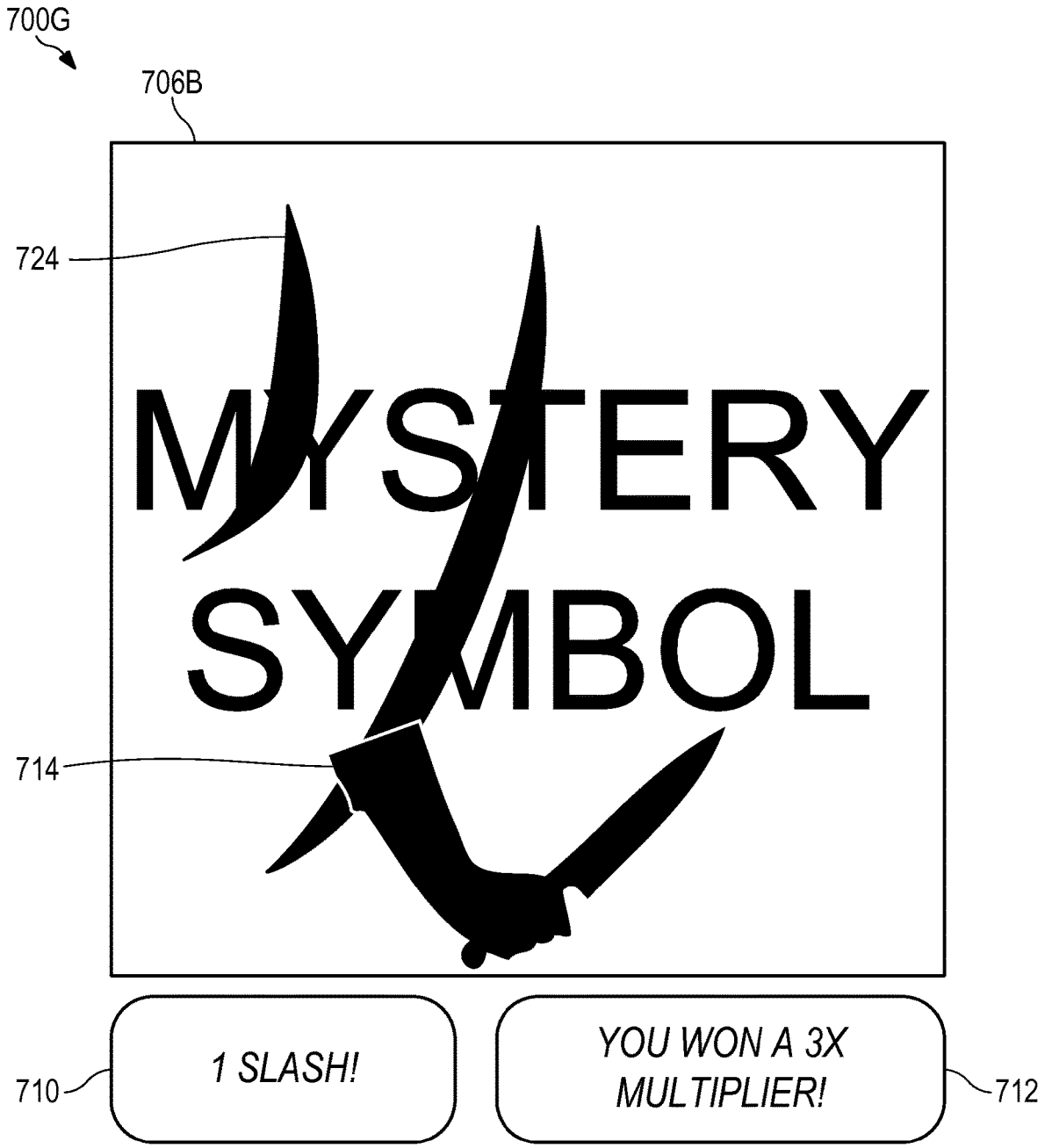
FIG. 7G is another illustration of slash game play on a gaming device, according to one embodiment.
Figure 7H:
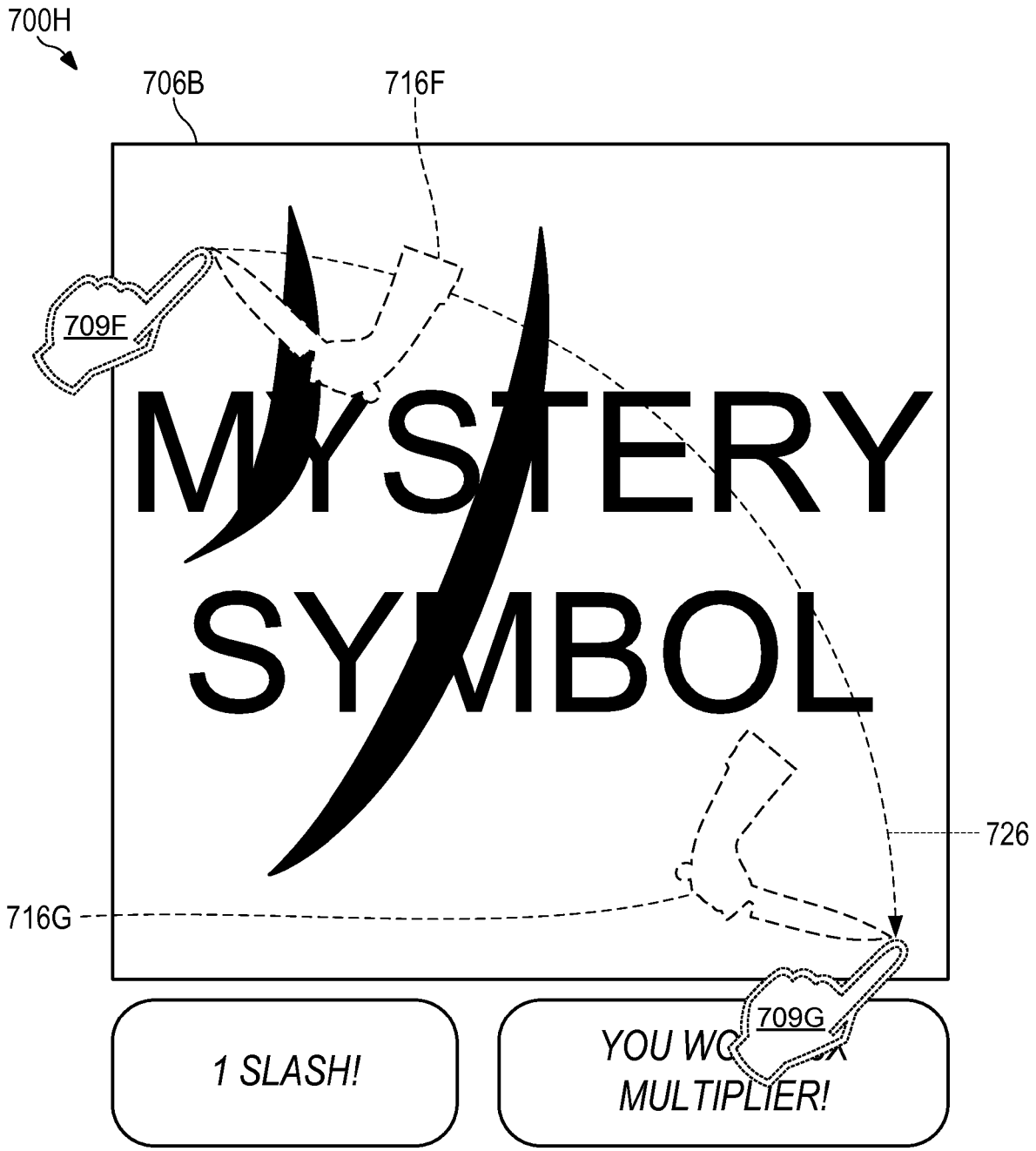
FIG. 7H is another illustration of slash game play on a gaming device, according to one embodiment.
Figure 7J:
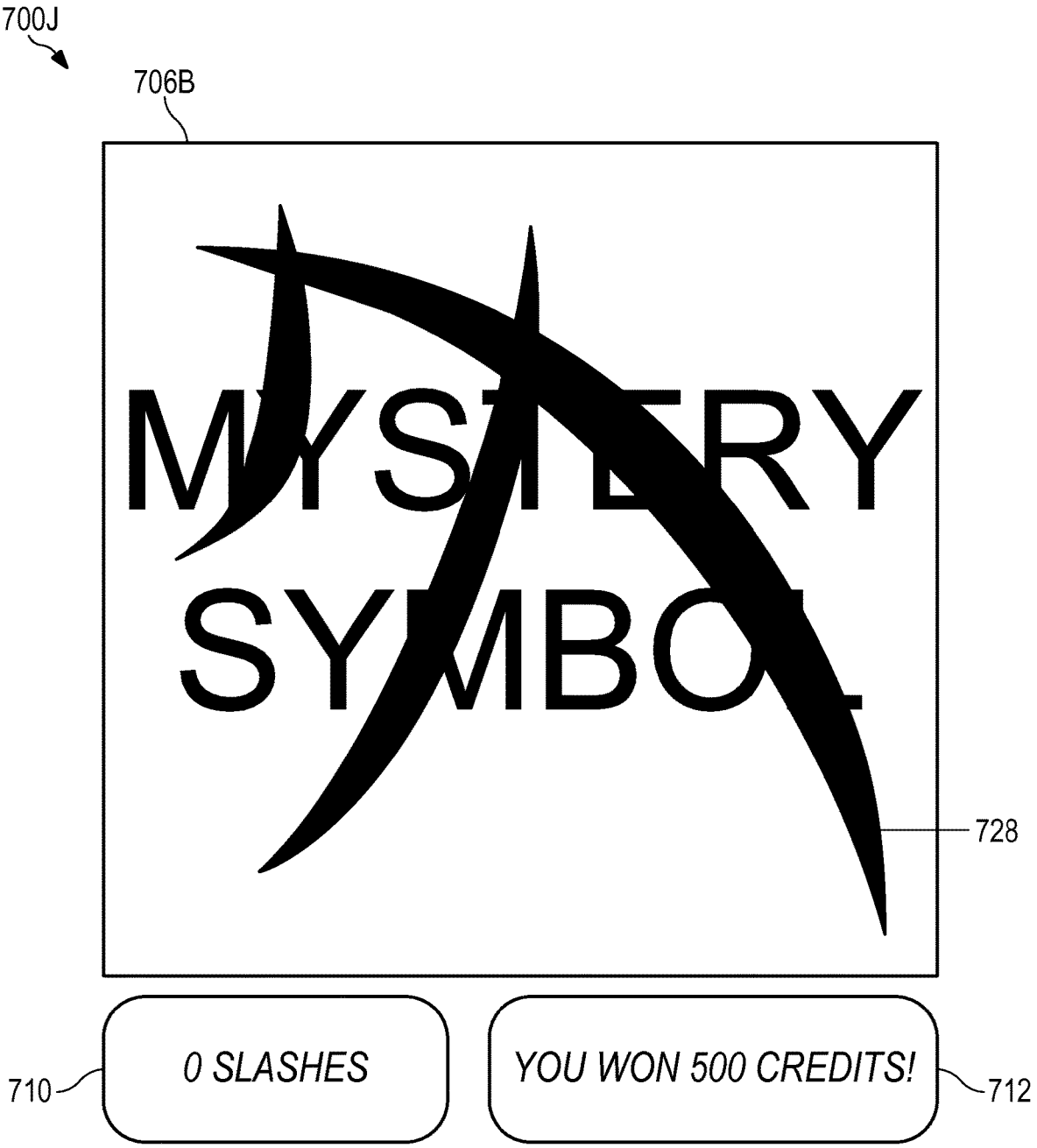
FIG. 7J is another illustration of slash game play on a gaming device, according to one embodiment.

In FIG. 7G, another illustration of slash game play on a gaming device is shown, according to one embodiment. In this example, the player has already slashed (twice and/or any number (e.g., 1–N)) at the mystery symbol but the mystery symbol may have multiple levels which can be reached by continuing to slash at the object. In this example, a fifth slashing image 724 may have been implemented by the player and generated a 3× multiplier winner. In another example seen in FIG. 7H, a sixth slashing image 716F and a seventh slashing image 716G have created a slashing image via a second slashing path 726 to generate the 3× multiplier winner and/or any number (e.g., 1–N) multiplier winner. In FIG. 7J, another illustration of slash game play on a gaming device is shown, according to one embodiment. In this example, another slashing input has generated a 500 credit winner via another slashing image 728.

In one example, the player may utilize 3D gesturing technology discussed above to implement one or more slashing actions. For example, the player may move one or more of their body parts to initiate one or more slashing (and/or other action) actions in one or more game plays. In one example, a person may move their arms in a downward motion to simulate and/or initiate via one or more sensors one or more slashing actions. In another example, a person may move their right arm from above their head to below their head and/or waist to initiate an action.

Figure 8A:
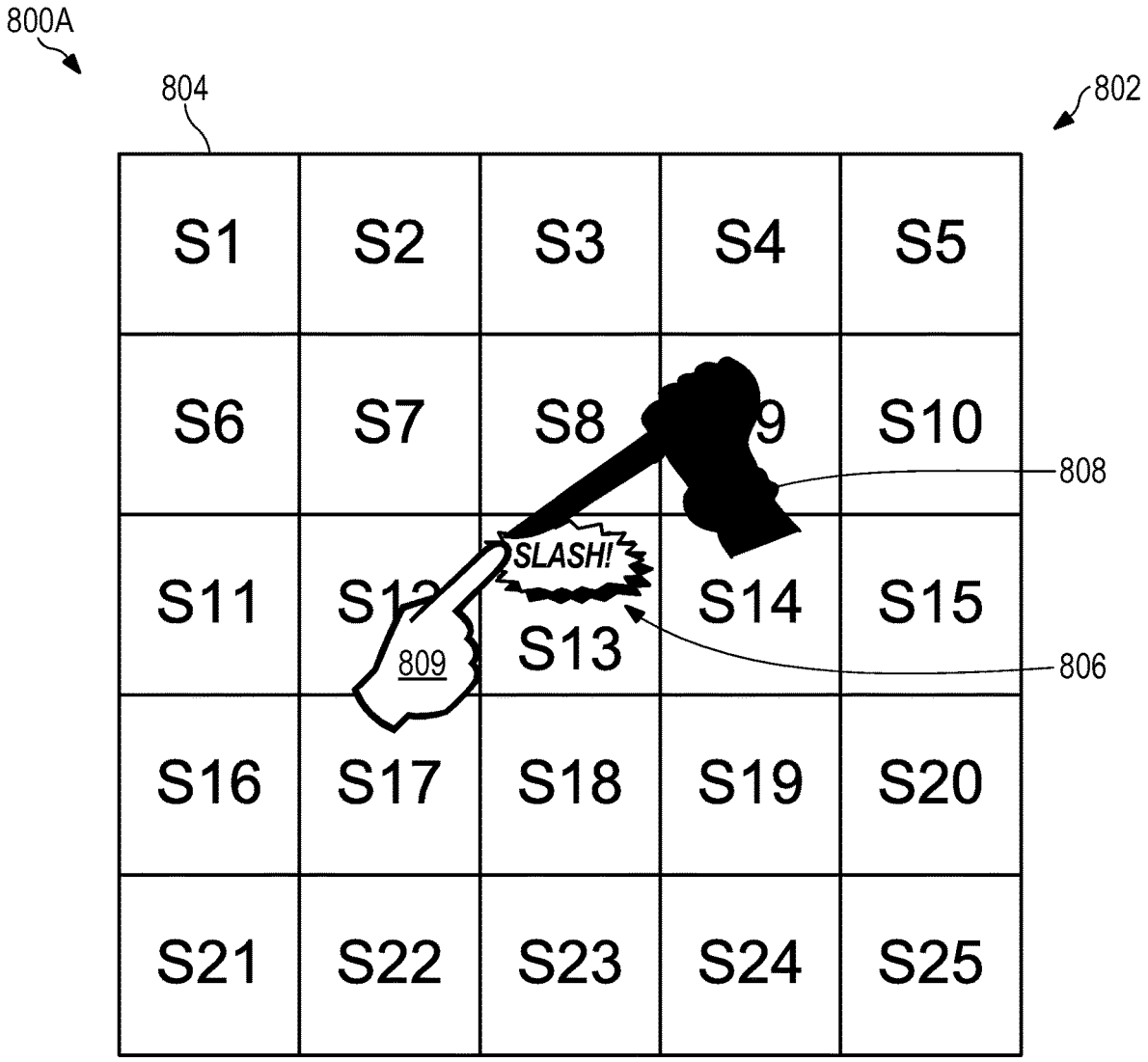
FIG. 8A is another illustration of slash game play on a gaming device, according to one embodiment.
Figure 8B:
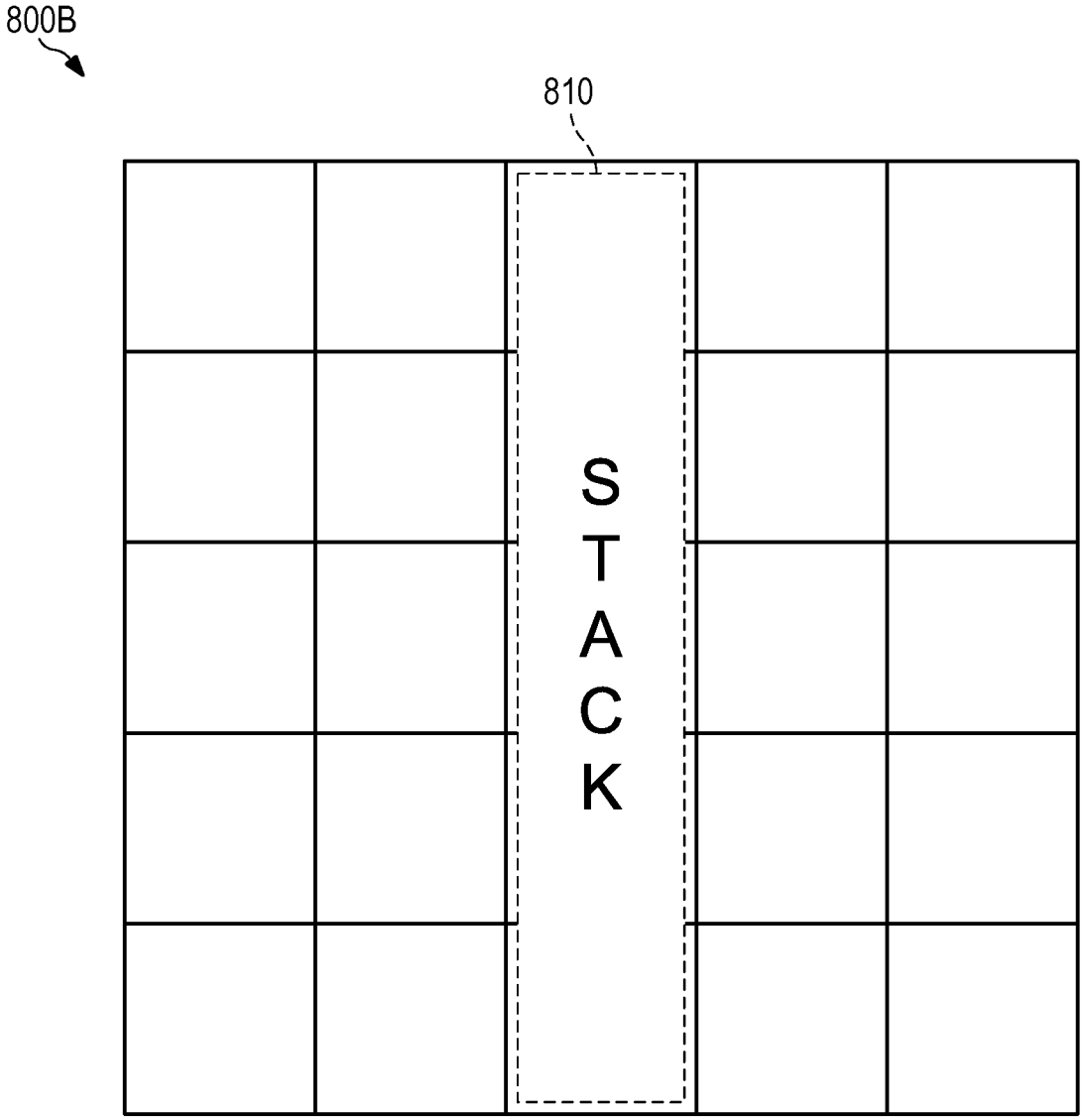
FIG. 8B is another illustration of slash game play on a gaming device, according to one embodiment.

In FIG. 8A, another illustration of slash game play on a gaming device is shown, according to one embodiment. A fifth image 800A may include a display 802, one or more reels 804, a first slash symbol 806, a slash image 808, and a pointer 809. In one example, the player selects first slash symbol 806 which is transformed into a first stacked symbol 810 (see FIG. 8B). First stacked symbol 810 is a one column section (e.g., third column and all rows).

Figure 8C:
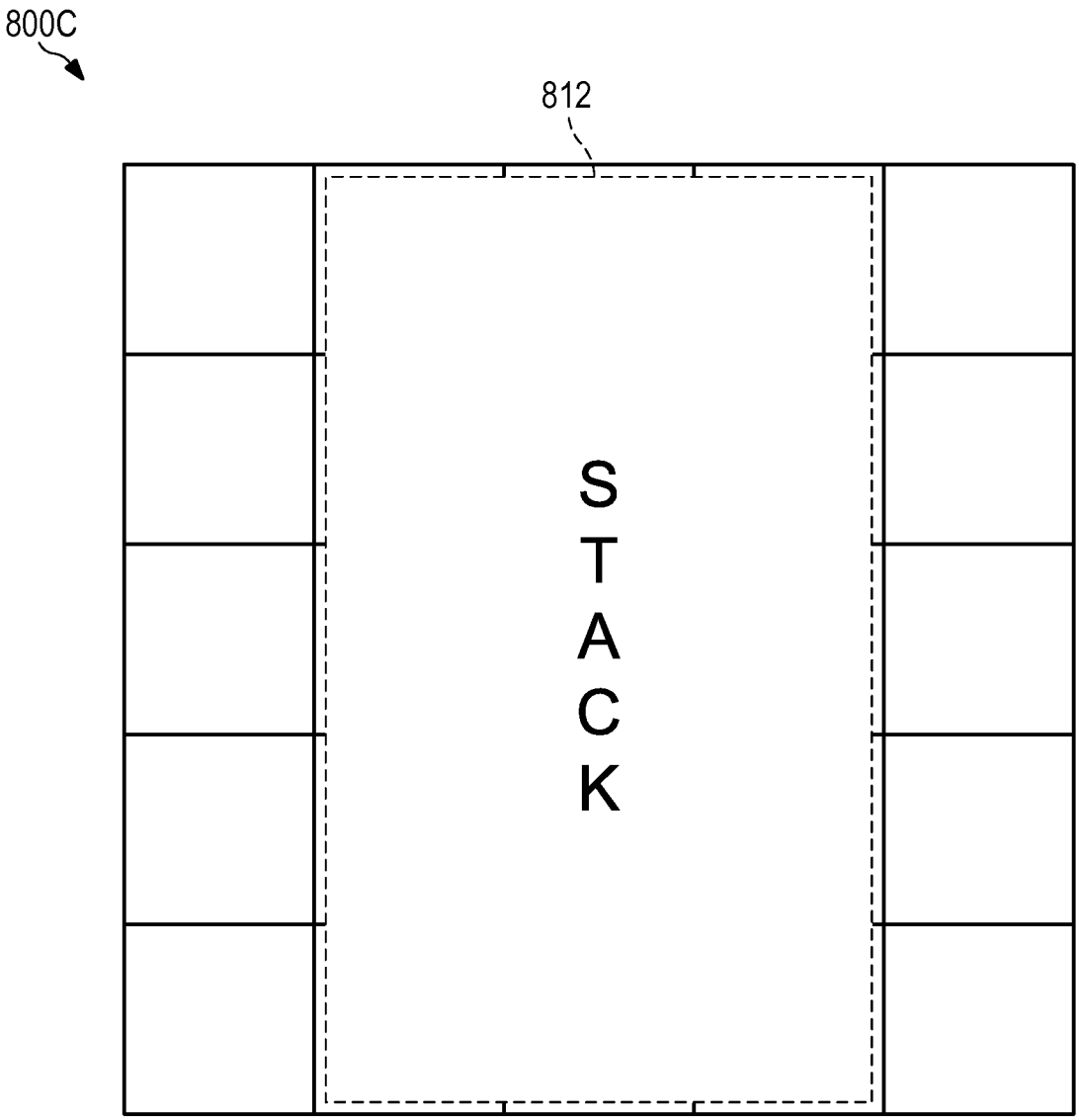
FIG. 8C is another illustration of slash game play on a gaming device, according to one embodiment.
Figure 8D:
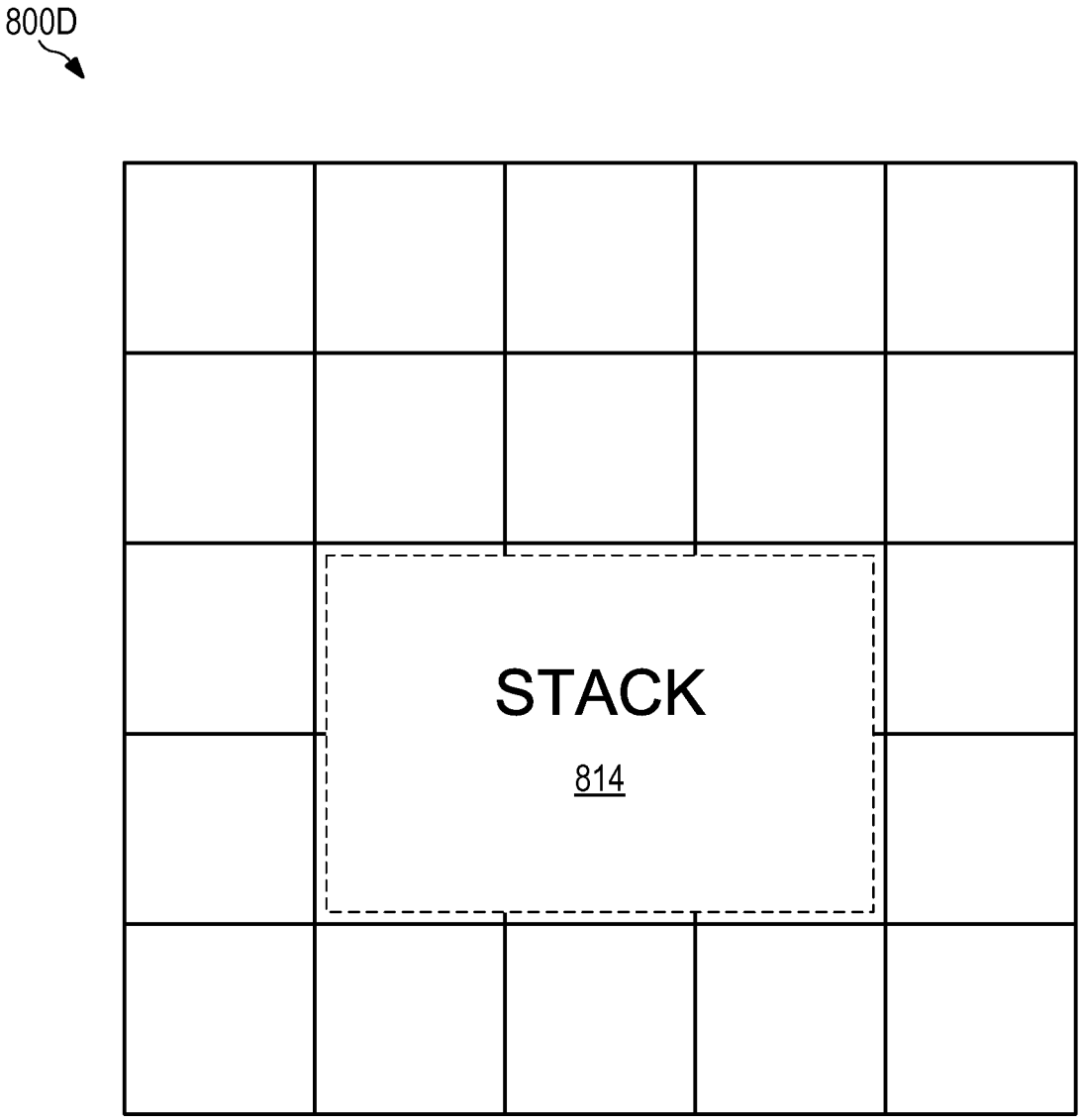
FIG. 8D is another illustration of slash game play on a gaming device, according to one embodiment.
Figure 8E:
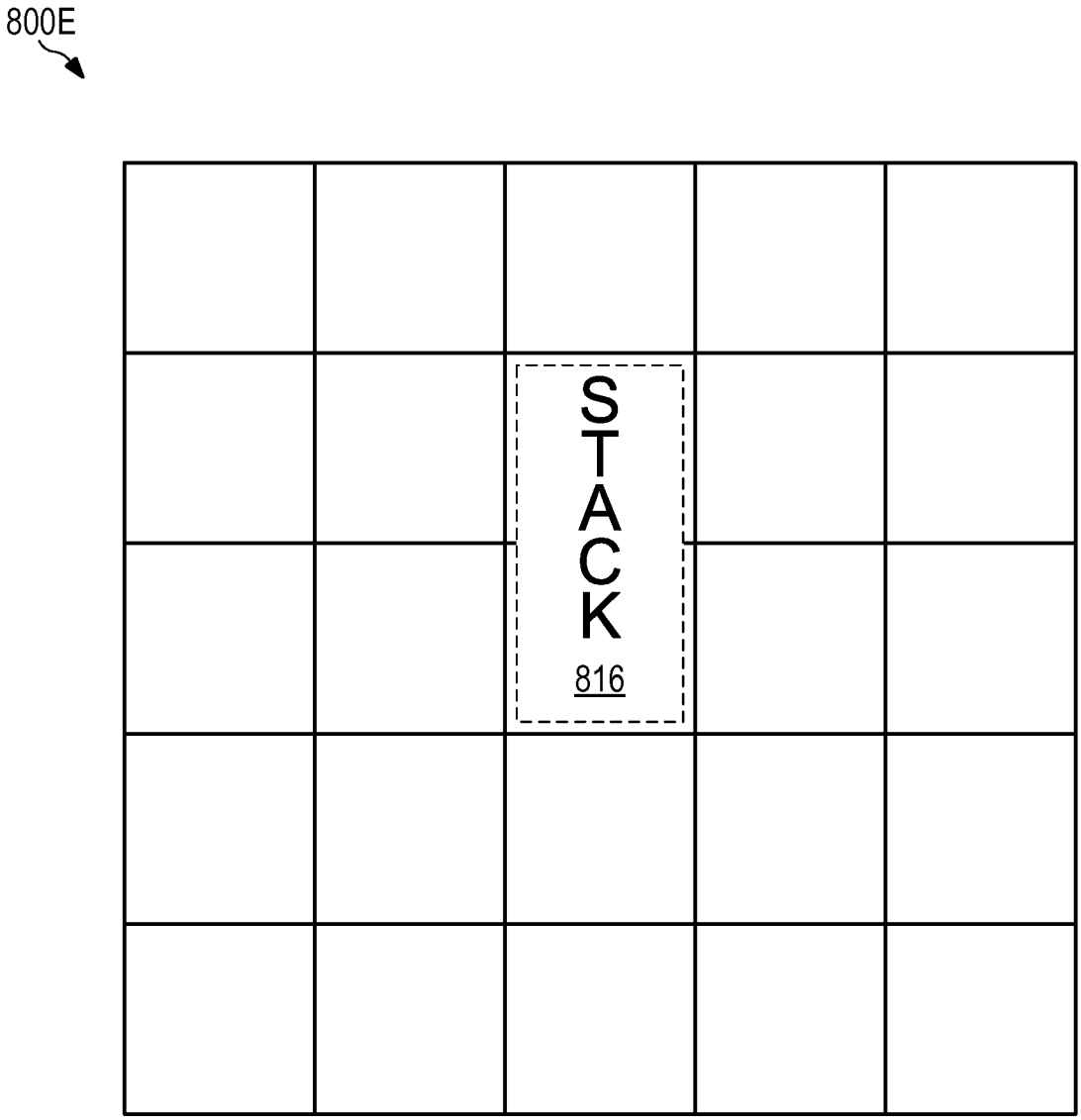
FIG. 8E is another illustration of slash game play on a gaming device, according to one embodiment.
Figure 8F:
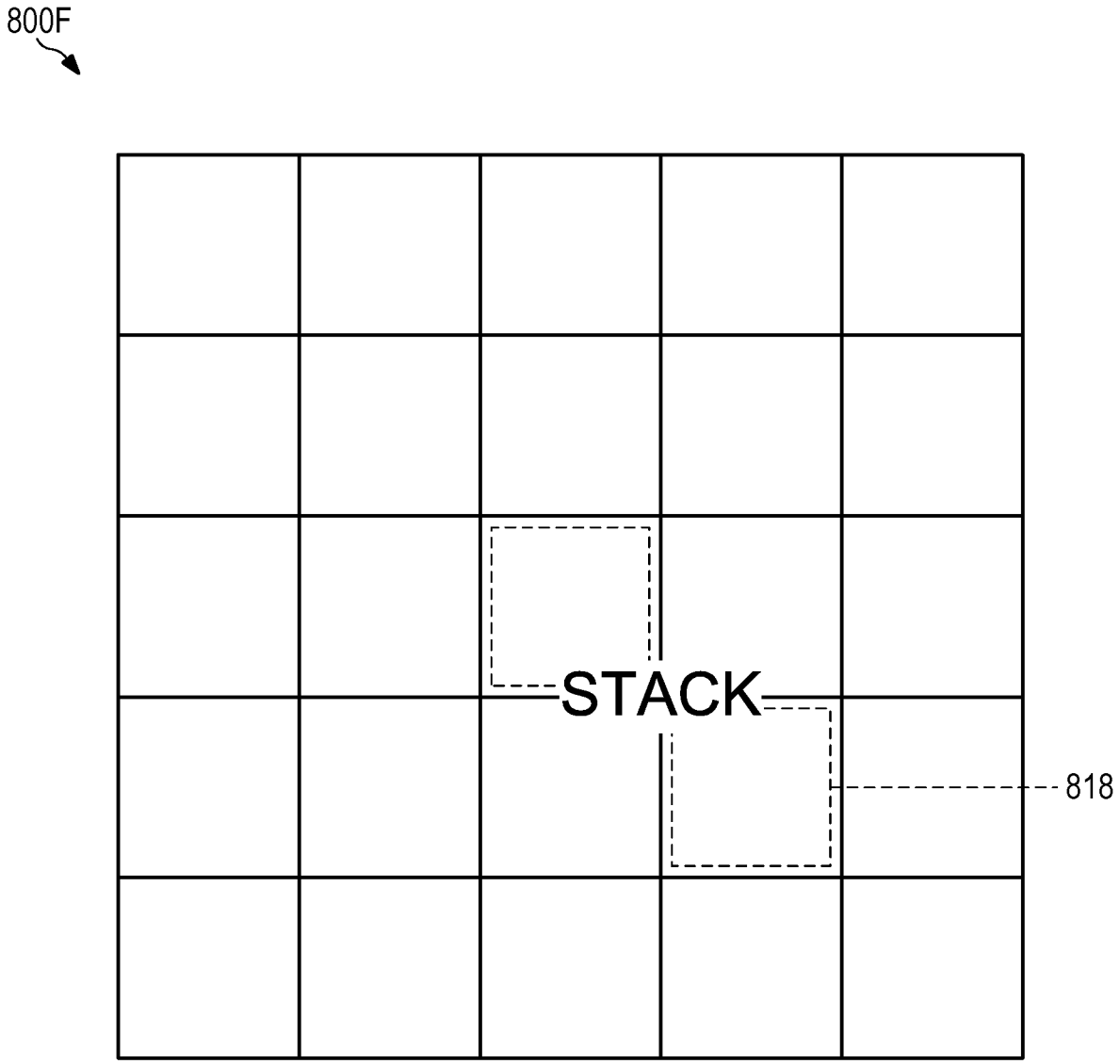
FIG. 8F is another illustration of slash game play on a gaming device, according to one embodiment.

In another example as seen in FIG. 8C, the player selects first slash symbol 806 which is transformed into a second stacked symbol 812. In this example, second stacked symbol 812 is a three column section (e.g., second column all rows, third column all rows, and fourth column all rows). In another example seen in FIG. 8D, the player selects first slash symbol 806 which is transformed into a third stacked symbol 814. In this example, third stacked symbol 814 is an area that includes various spaces (e.g., third row second column, third row third column, third row fourth column, fourth row second column, fourth row third column, and fourth row fourth column). The slashable symbol may turn into any area (e.g., one space, two spaces, etc.) and have any shape (e.g., straight line, a box, an L shape, an S shape, etc.). In another example, the player selects first slash symbol 806 which is transformed into a fourth stacked symbol 816. In this example, fourth stacked symbol 816 is an area that includes various spaces (e.g., second row third column and third row third column (see FIG. 8E). In another example, a fifth stacked symbol 818 is generated as seen in FIG. 8F. In one example, fifth stacked symbol 818 includes an area of third row third column and fourth row fourth column.

Figure 9:
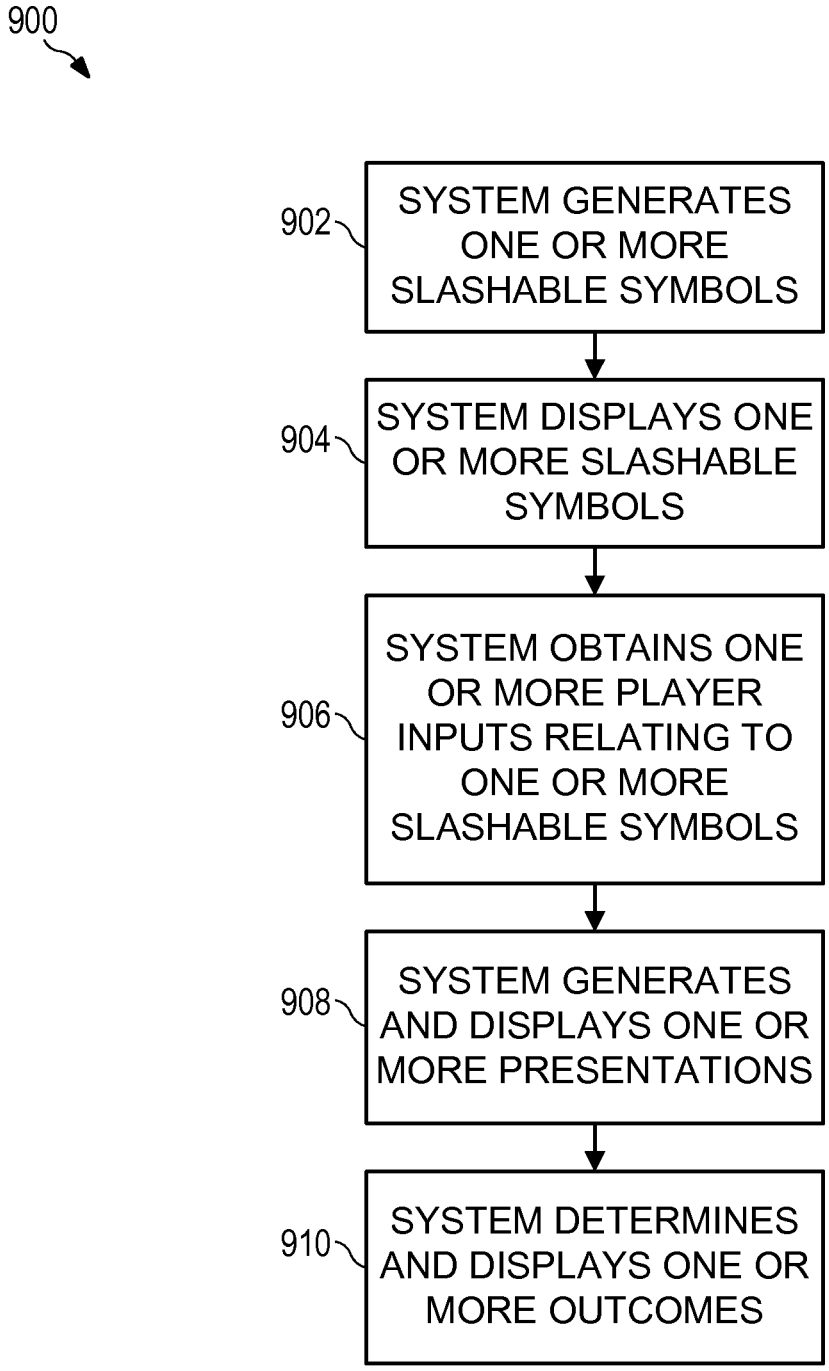
FIG. 9 is a game play flow diagram, according to one embodiment.

In FIG. 9, a game play flow diagram 900 is shown, according to one embodiment. The method may include the system and/or device generating one or more slashable symbols (step 902). The method may include displaying one or more slashable symbols (step 904). The method may include obtaining one or more player inputs relating to one or more slashable symbols (step 906). The method may include generating and/or displaying one or more presentations relating to one or more slashable symbols (step 908). The method may include determining and displaying one or more outcomes (step 910).

Figure 10:
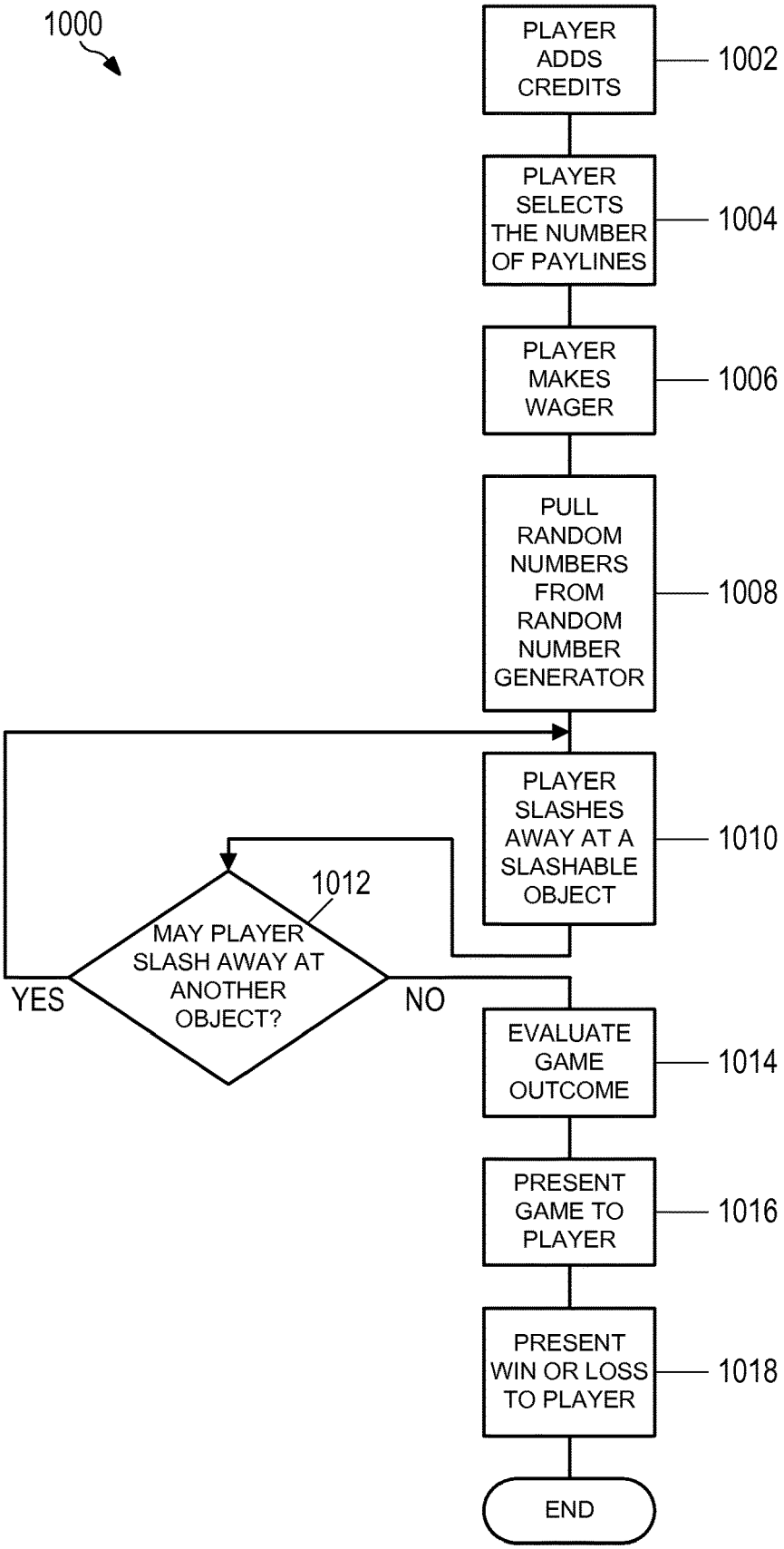
FIG. 10 is a flow diagram for game play, according to one embodiment.

In FIG. 10, a flow diagram for game play 1000 is shown, according to one embodiment. The method may include the player adding credits (step 1002). The method may include the player selecting the number of paylines (step 1004). The method may include the player making a wager (step 1006). The method may include the random number generator pulling one or more random numbers (step 1008). The method may include the player slashing away at a slashable object (step 1010). The method may include one or more processors determining whether the player may slash away at another object and/or additional slashes at one or more already slashed objects (step 1012). If the player may not slash away at another object and/or additional slashes at one or more already slashed objects, then the method may evaluate one or more game outcomes (step 1014). The method may present one or more game outcomes to the player (step 1016). The method may present one or more winning and/or losing outcomes to the player (step 1018). If the player may slash away at another object and/or additional slashes at one or more already slashed objects, then the method may return to step 1010.

Figure 11:
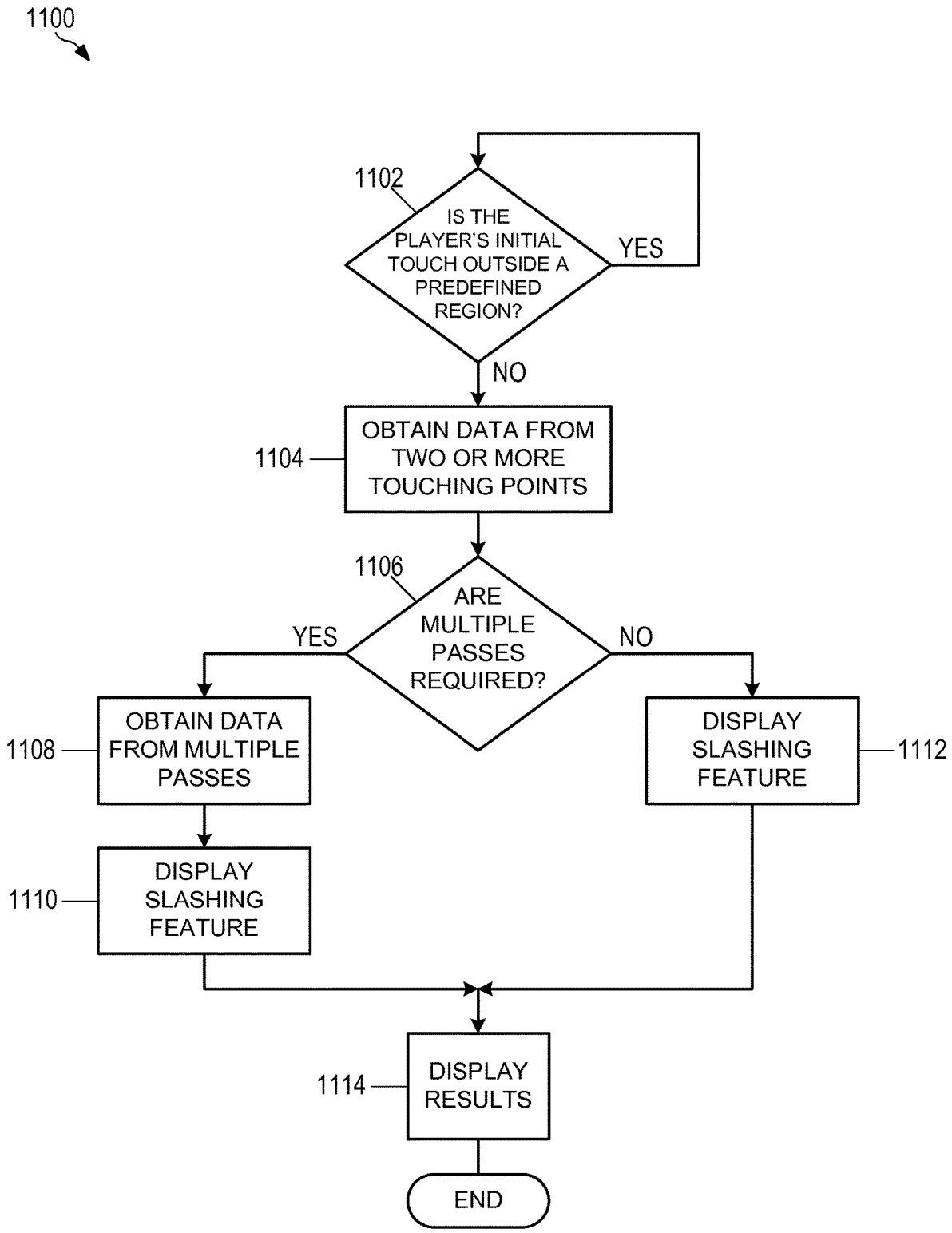
FIG. 11 is a flow diagram for game play, according to one embodiment.

In FIG. 11, a flow diagram for game play is shown, according to one embodiment. The method may include one or more processors determining whether the player's initial touch was outside one or more predefined regions (step 1102). If the player's initial touch was outside the one or more predefined regions, then the method may loop back to step 1102. If the player's initial touch was not outside the one or more predefined regions (but inside the one or more predefined regions), then the method may obtain data from two or more touching points (step 1104). The method may include one or more processors determining whether multiple passes are required to complete one or more inputs and/or tasks (step 1106). If no more passes are required, then the method may display one or more slashing features (step 1112) and display one or more results (step 1114). If one or more additional passes are required, then the method may obtain data from one or more additional passes (step 1108), display one or more slashing features (step 1110), and display one or more results (step 1114).

Figure 12:
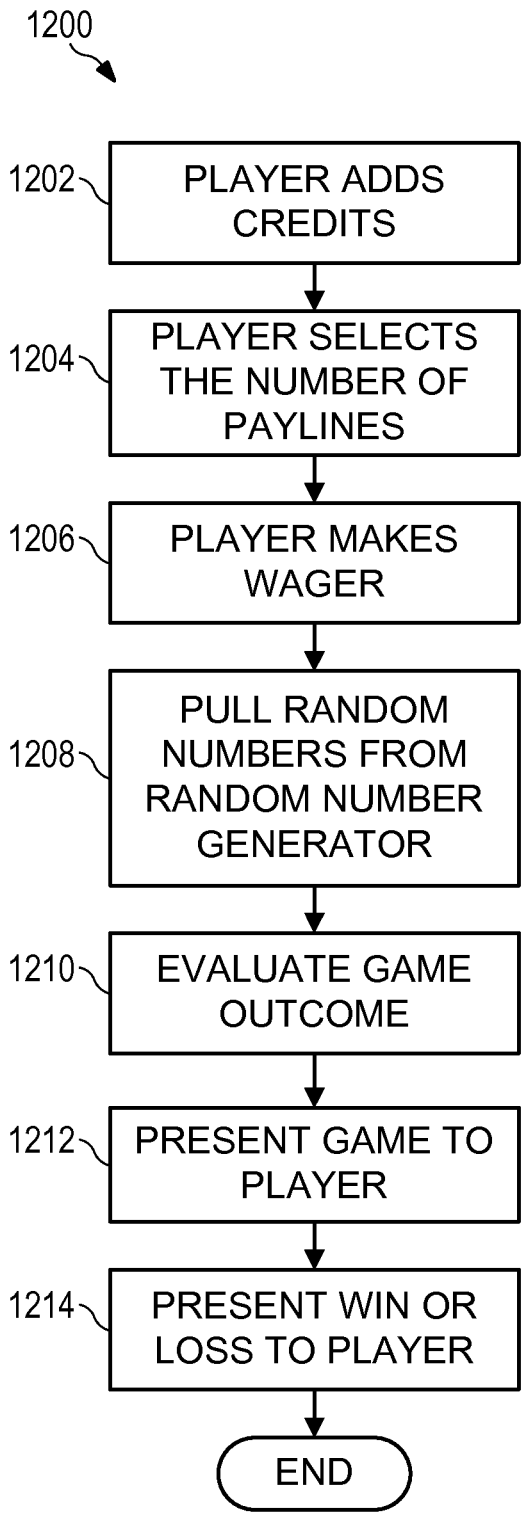
FIG. 12 is a flow diagram for game play, according to one embodiment.

In FIG. 12, a process flowchart of one example of a primary game play 1200 on an electronic gaming system is shown, according to one embodiment. The method may include the step of a player adding credit to the electronic gaming system (step 1202). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1204, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1206, the player makes a wager on the game. In one embodiment, the wager may be a multiple of the number of paylines selected at step 1204. In another embodiment, the wager may not be a multiple of the number of paylines selected at step 1204. In a further embodiment, the wager may include a side-wager (e.g., ante bet), which may, in one example of such an embodiment, be used to make the player eligible to be awarded the extra functionality discussed above. It should be appreciated that in some embodiments, the order of steps 1204 and 1206 may be not critical, and so for example, a player can select the wager they wish to place, and then select the number of paylines they want it applied to, and that these embodiments are expressly contemplated as being within the scope of the present disclosure.

Continuing to step 1208, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 1210 and 1212, the gaming system utilizes the random numbers pulled at step 1208 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1214, the win or loss outcome may be identified for the player. In one embodiment, this step can include additional messaging, which provides information related to the win or loss, such as why the player won or lost. In another embodiment, this step can include identification of the amount of any award earned by the player.

Figure 13:
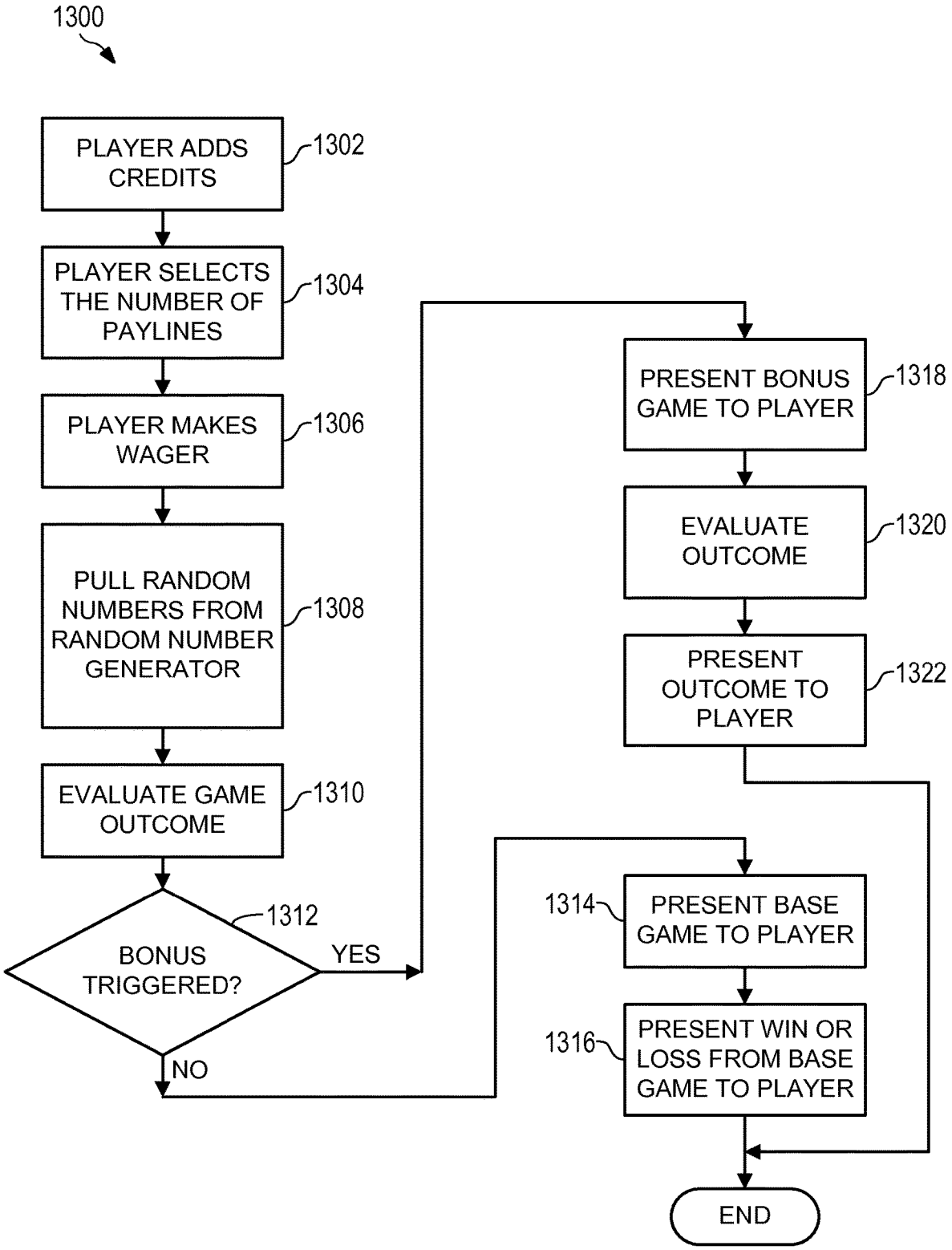
FIG. 13 is a flow diagram for game play, according to one embodiment.

FIG. 13 is a process flowchart of one example of a combined primary and secondary game play 1300 on an electronic gaming system, according to one embodiment. The method may include the step of a player adding credit to the electronic gaming system (step 1302). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1304, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1306, the player makes a wager on the game. In one embodiment, the wager may be a multiple of the number of paylines selected at step 1304. In another embodiment, the wager may not be a multiple of the number of paylines selected at step 1304. In a further embodiment, the wager may include a side-wager, which may, in one example of such an embodiment, be used to make the player eligible to be awarded the extra functionality discussed above. It should be appreciated that in some embodiments, the order of steps 1304 and 1306 may be not critical, and so for example, a player can select the wager they wish to place, and then select the number of paylines they want it applied to, and that these embodiments may be expressly contemplated as being within the scope of the present disclosure.

Continuing to step 1308, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 1310, the gaming system utilizes the random numbers pulled at step 1308 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1312, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the $2^{nd}$, $3^{rd}$ and $4^{th}$ reel. In another example, the bonus game may be triggered if matching symbols are displayed on the $1^{st}$, $2^{nd}$ and $3^{rd}$ reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 1314, where the base game may be fully presented to the player. As discussed above, the orders of step 1310, 1312, and 1314 can be changed without affecting the novel concepts disclosed herein.

At step 1316, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 1312 that a bonus or secondary game was triggered, then process 1300 continues to step 1318, where the secondary game may be presented to the player. As discussed above, there are numerous ways to present the secondary or bonus game to the player.

At steps 1320 and 1322, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player.

In one embodiment, instead of the process 1300 ending after step 1322, the process continues to step 1314 so as to finalize the primary game outcome presentation to the player.

One or more sensors may obtain and/or transmit one or more data points (e.g., positional data, temperature data, etc.) relating to one or more audio devices, one or more display devices, audio interface area, audio support area, audio locking device, one or more electrical attachment devices, one or more attachment areas, electronic gaming device 100, electronic gaming system 200, first audio device, wall of the audio installation area, back of the audio installation area, one or more audio interfaces, one or more electrical attachment points, an input area, one or more input devices, second audio device, front-mounted audio device, audio interface locked area, one or more electrical interconnection points, one or more electrical wires, one or more springs, one or more motors, one or more adjustable devices, and/or one or more sensors to one or more processors.

One or more sensors may obtain and/or transmit one or more data points (e.g., positional data, temperature data, etc.) relating to one or more audio devices, one or more display devices, one or more electrical wires, one or more springs, one or more motors, one or more adjustable devices, and/or one or more sensors to one or more processors.

In one embodiment, the electronic gaming device may include a plurality of reels. The one or more paylines may be formed on at least a portion of the plurality of reels. The electronic gaming device may include a memory.

In one embodiment, the electronic gaming device may include a plurality of reels. The plurality of reels may include one or more areas. The electronic gaming device may include a processor and a memory. The memory may include one or more slash feature structures. The processor may generate one or more symbols to be located in the one or more areas. The processor may move a first slash to a first replacement location based on the first replacement location having a top award amount.

In another example, the processor may initiate a base game, a bonus game, and a slash game. In another embodiment, the method of providing game play via an electronic gaming device may include: initiating via one or more processors a base game; initiating via the one or more processors a slash game; and/or moving via the one or more processors one or more slashes to one or more replacement locations.

In one embodiment, an electronic gaming device may include a plurality of reels where the plurality of reels includes one or more areas. The electronic gaming device may include a memory and a processor. The memory may include one or more slash feature structures. The processor may generate one or more symbols to be located in the one or more area and/or generate one or more slashing symbols.

In another example, the processor may: obtain one or more inputs relating to the one or more slashing symbols; generate a first payout based on the one or more symbols; generate one or more slashed symbols based on the one or more inputs relating to the one or more slashing symbols; generate a second payout based on at least a portion of the one or more symbols and the one or more slashed symbols; obtain one or more slashing inputs relating to the one or more slashing symbols via at least one of a 3D sensor and a 3D device; generate a first payout based on the one or more symbols and to generate one or more slashed symbols based on the one or more slashing inputs relating to the one or more slashing symbols; generate a second payout based on at least a portion of the one or more symbols and the one or more slashed symbols; generate and display a mystery symbol; obtain one or more inputs related to the mystery symbol; and/or reveal at least two levels (and/or any level amount (e.g., 1–N)) of the mystery symbol based on at least two inputs (and/or any input amount (e.g., 1–N)) relating to the mystery symbol.

In another embodiment, a method of providing game play via an electronic gaming device may include: initiating via one or more processors a base game; generating via the one or more processors one or more slashing symbols; displaying the one or more slashing symbols; obtaining one or more inputs relating to the one or more slashing symbols; generating a first payout based on the one or more symbols and to generating one or more slashed symbols based on the one or more inputs relating to the one or more slashing symbols; generating a second payout based on at least a portion of the one or more symbols and the one or more slashed symbols; and/or obtaining one or more slashing inputs relating to the one or more slashing symbols via at least one of a 3D sensor and a 3D device.

In another example, an electronic gaming system may include a server which may include a server processor and a server memory. The system may include a display device including a plurality of reels where the plurality of reels includes one or more areas. The server memory may include one or more slash feature structures. The server processor may generate one or more symbols to be located in the one or more areas and/or generate one or more slashing symbols.

In another example, the server processor may: obtain one or more inputs relating to the one or more slashing symbols; generate a first payout based on the one or more symbols and to generate one or more slashed symbols based on the one or more inputs relating to the one or more slashing symbols; generate a second payout based on at least a portion of the one or more symbols and the one or more slashed symbols; and/or obtain one or more slashing inputs relating to the one or more slashing symbols via at least one of a 3D sensor and a 3D device.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed. Further, one or more gaming options may be Internet based gaming options. Therefore, all of the examples and/or embodiments may be utilized via an Internet based gaming system.

The invention claimed is:

1. A method of providing game play to a player via an electronic gaming device comprising the machine implemented steps of:

receiving a wager at a wager accepting device of said electronic gaming device thereby creating a credit balance;

initiating via one or more processors of said electronic gaming device a base game in response to said wager;

displaying, via at least one electronic video display of said electronic gaming device, an initial game outcome comprising game symbols associated with a plurality of game symbol positions, one or more of said game symbol positions displaying both a game symbol and a slashing symbol;

receiving a first slashing motion input from said player relating to a first slashing symbol of said slashing symbols via an input device of said electronic gaming device;

modifying said initial game outcome by displaying a mystery symbol in place of the first slashing symbol in response to said first slashing motion input and by displaying a mystery prize option corresponding to the mystery symbol;

receiving at least one second slashing motion input from said player relative to said displayed mystery prize option;

displaying at least one mystery prize in place of the displayed mystery prize option in response to said at least one second slashing motion input;

increasing the credit balance when said at least one mystery prize has an associated payout; and dispensing at least a portion of said credit balance to said player by transferring a monetary value represented by said at least a portion of said credit balance to a player's financial account remotely from said electronic gaming device or by dispensing at least one physical element which represents a monetary value represented by said at least a portion of said credit balance.

2. The method of claim 1, wherein said first slashing motion input and said at least one second slashing motion input are received via at least one of a 3D sensor and a 3D device.

3. An electronic gaming system comprising:

a server including a server processor and a server memory, the server processor configured to receive a wager thereby creating a credit balance;

a game display device comprising at least one electronic video display;

a non-transitory, computer readable medium comprising machine-readable code, which when executed by the server processor, causes the game display device, in response to said wager:

to display via said at least one electronic video display, an initial game outcome comprising game symbols associated with a plurality of game symbol positions, one or more of said game symbol positions displaying both a game symbol and a slashing symbol;

to receive a first slashing motion input from a player relative to a first slashing symbol of said slashing symbols;

to display via said at least one electronic display a mystery game symbol in place of the first slashing symbol at the game symbol position where said first slashing motion input was received and a mystery prize option corresponding to the mystery game symbol;

to receive at least one second slashing motion input from said at least one player relative to said displayed mystery prize option;

to display at least one mystery prize in place of the displayed mystery prize option in response to said at least one second slashing motion input; and said server processor further configured;

to determine if said at least one mystery prize has an associated payout;

to increase the credit balance when said mystery prize has an associated payout; and to dispense at least a portion of said credit balance to said player by transferring a monetary value represented by said at least a portion of said credit balance to a player's financial account remotely from said electronic gaming device or by dispensing at least one physical element which represents a monetary value represented by said at least a portion of said credit balance.

4. The electronic gaming system of claim 3, wherein said server processor is configured to determine a first payout based on said initial game.

5. The electronic gaming system of claim 3, wherein said first slashing motion input and said at least one second slashing motion input are received via at least one of a 3D sensor and a 3D device of said game display device.

6. An electronic gaming machine configured to present a game to at least one player, the gaming machine comprising:

at least one processor;

at least one electronic display;

at least one player input device;

a wager accepting device; and a non-transitory, computer readable medium comprising machine-readable code, which when executed by the controller, causes the gaming machine:

to accept a wager from the player via the wager accepting device thereby creating a credit balance;

to, in response to said wager, display via said at least one electronic display, an initial game outcome comprising game symbols associated with a plurality of game symbol positions, one or more of said game symbol positions displaying both a game symbol and a slashing symbol;

to receive a first slashing motion input from said at least one player relative to a first slashing symbol of said slashing symbols;

to modify said initial game outcome by displaying via said at least one electronic display a mystery symbol in place of the first slashing symbol and a mystery prize option corresponding to the mystery symbol in response to said first slashing motion input;

to receive at least one second slashing motion input from said at least one player relative to said mystery prize option;

to display at least one mystery prize in place of the mystery prize option in response to said at least one second slashing motion input;

to increase the credit balance when said at least one mystery prize has an associated payout; and to dispense at least a portion of said credit balance to said player by transferring a monetary value represented by said at least a portion of said credit balance to a player's financial account remotely from said electronic gaming device or by dispensing at least one physical element which represents a monetary value represented by said at least a portion of said credit balance.

7. The electronic gaming machine of claim 6 wherein said first slashing motion input and said at least one second slashing motion input comprise a slashing movement detected by a detector associated with said at least one electronic display.

8. The electronic gaming machine of claim 6 wherein said first slashing motion input is detected in an area corresponding to a location where a slashing symbol is displayed via said at least one electronic display and said at least one second slashing motion input is detected in an area corresponding to where said mystery prize option is displayed via said at least one electronic display.

9. The electronic gaming machine of claim 6 wherein said first slashing motion input corresponds to a slashing symbol at a particular game symbol position and said mystery symbol is displayed in replacement of said game symbol displayed at said particular game symbol position.

10. The electronic gaming machine of claim 6 comprising determining a first payout based on said initial game outcome and determining a second payout based on said initial game outcome as modified by said at least one mystery prize.

11. The electronic gaming machine of claim 6, further comprising at least one of a 3D sensor and a 3D device and wherein said processor is configured to obtain said first slashing motion input and said at least one second slashing motion input via at least one said 3D sensor and 3D device.

* * * * *